US011814220B2

(12) United States Patent
Acevedo Beltrán

(10) Patent No.: US 11,814,220 B2
(45) Date of Patent: Nov. 14, 2023

(54) SQUARE LIQUIDS RETAINING BOWL-TYPE FOLDED CONTAINER

(71) Applicant: Guillermo Hernán Acevedo Beltrán, Bogotá (CO)

(72) Inventor: Guillermo Hernán Acevedo Beltrán, Bogotá (CO)

( * ) Notice: Subject to any disclaimer, the term of this patent is extended or adjusted under 35 U.S.C. 154(b) by 4 days.

(21) Appl. No.: 17/674,798

(22) Filed: Feb. 17, 2022

(65) Prior Publication Data

US 2022/0169415 A1 Jun. 2, 2022

Related U.S. Application Data

(63) Continuation-in-part of application No. PCT/IB2020/057702, filed on Aug. 14, 2020.

(30) Foreign Application Priority Data

Aug. 17, 2019 (CO) ..... NC2019/0008967
Jun. 27, 2021 (CO) ..... NC2021/0008440

(51) Int. Cl.
*B65D 5/20* (2006.01)
*B65D 5/42* (2006.01)
*B65D 65/40* (2006.01)
*B65D 5/46* (2006.01)

(52) U.S. Cl.
CPC ..... *B65D 5/2038* (2013.01); *B65D 5/2033* (2013.01); *B65D 5/4266* (2013.01); *B65D 5/46096* (2013.01); *B65D 65/40* (2013.01)

(58) Field of Classification Search
CPC .. B65D 5/2038; B65D 5/2033; B65D 5/4266; B65D 5/46096; B65D 65/40; B65D 5/2023; B65D 5/2061; B65D 5/4279; B65D 5/40; B65D 5/029; B65D 5/06; B31B 2110/10
USPC ..... 229/110, 405
See application file for complete search history.

(56) References Cited

U.S. PATENT DOCUMENTS 2,577,109 A 12/1951 Cranshaw
3,977,594 A * 8/1976 Swan ..... B65D 5/08 229/184
4,930,680 A * 6/1990 Hanus ..... B65D 5/06 229/110
5,460,324 A * 10/1995 Vinther ..... B65D 5/3664 229/405
5,641,117 A 6/1997 Barker et al.
(Continued)

FOREIGN PATENT DOCUMENTS

CO 16120942 B1 3/2017
CO 20170002609 10/2017
(Continued)

*Primary Examiner* — Christopher R Demeree
(74) *Attorney, Agent, or Firm* — The Morales Law Firm; Joseph L. Morales, Esq.

(57) ABSTRACT

A liquid retaining folded laminar container made from a cold or heat pre-cut paper or plastic sheet. The laminar container comprises engraved lines that enable folding to form a container. The laminar container has a circular base having a double concentric cone. The laminar container's sides close on itself to create a self-bearing square, or geometric, outline container with lids. The container is manually formed from the an engraved laminar sheet. The containers can be stored and transported flat.

19 Claims, 23 Drawing Sheets

(56) References Cited

U.S. PATENT DOCUMENTS

| | | | | | |
|---|---|---|---|---|---|
| 5,676,306 | A * | 10/1997 | Lankin | B65D 3/20 | 229/5.5 |
| 7,681,784 | B2 * | 3/2010 | Lang | B65D 3/20 | 229/5.5 |
| 8,777,825 | B1 * | 7/2014 | Kling | B65D 5/2038 | 493/162 |
| 9,045,246 | B2 * | 6/2015 | Nishida | B65D 5/24 | |

FOREIGN PATENT DOCUMENTS

| | | | |
|---|---|---|---|
| KR | 20140006481 | U * | 12/2014 |
| WO | 2011150698 | A1 | 12/2011 |

* cited by examiner

SQUARE LIQUIDS RETAINING BOWL-TYPE FOLDED CONTAINER

CROSS-REFERENCE TO RELATED APPLICATIONS

This application is a continuation in part of international application PCT/IB2020/057702 filed on Aug. 14, 2020, which claims priority from Colombian application NC2019/0008967 filed on Aug. 17, 2019. This application also claims priority from Colombian application serial number NC2021/0008440 filed on Jun. 27, 2021. All of the above applications are incorporated herein by reference in their entirety.

BACKGROUND

Processed food industry uses disposable generic containers for transporting processed foods. These containers have a lid to avoid spills. The container can be used to eat directly from the container. Once the container is used, it is discarded.

Most of such containers are made of plastic. The containers are pre-formed and always keep their shape whether they are empty or full. Because of postformed or injected plastic manufacturing, stable structures have been developed that close either by means of an attached part or an additional element.

There are also paper containers, which may have large pre-formed windows with additional plastic lids and/or folded paper packs that are have bends and sticking tape. They are designed in covered paper sheets or laminates to protect them from humidity and they are closed with their own folding flaps through mechanical systems.

At the present time, there are various types of developments from a paper sheet coated or co-laminated with a plastic film that protects from the paper from humidity. For example, oriental food packaging containers are trapezoidal boxes. In this type of packaging, the co-laminated paper sheet is pre-cut and has marked bends and edges, wherein by container is formed by bending the sheet at the pre-marked bends and edges.

There are other bowl-type foldable containers, such as Guillermo Acevedo Beltran's patent application No 16120942 folding solution, which functions as a bowl to serve food in bulk but without the purpose to retain liquids. The main differences are stated below. The preformed outline of the container is a pentagon. Its base retains liquids, such as sauces or juices deposited in the container. The central cone folds itself to cause greater container capacity. Its lids may vary to provide more capacity volume and serve as handles for transport. Its shape, on closing, is square keeping circular base.

SUMMARY

A square liquid retaining bowl-type folded container characterized by the container body (3), whose outline is a brushed regular pentagon (3.1). In the pentagon center, the double concentric cone circular base brushed lines (1) are found. Said same center is the upper vertex of the overlap triangle (2). From the pentagon upper and side edges, the four fins that form the container lid System extend (4).

A foldable laminate container comprises a container body having an engraved geometric outline. The foldable laminate container further comprises a three engraved concentric circles, an internal circle, a middle circle, and an external circle. The concentric circles are configured to form a concentric cone circular base, a center of the concentric circular base is an upper vertex of an engraved overlap triangle. The foldable container is configured to fold into a three-dimensional container when the overlap triangle is folded and the concentric cone circular base forms an cone from the center to the internal circle, a base crest between the external circle and the internal circle, which are concentric to the cone.

BRIEF DESCRIPTION OF FIGURES

To complete the description and with the purpose to better understand the invention features, a series of illustrative figures are included.

DESCRIPTION OF INVENTION

Figure 1:
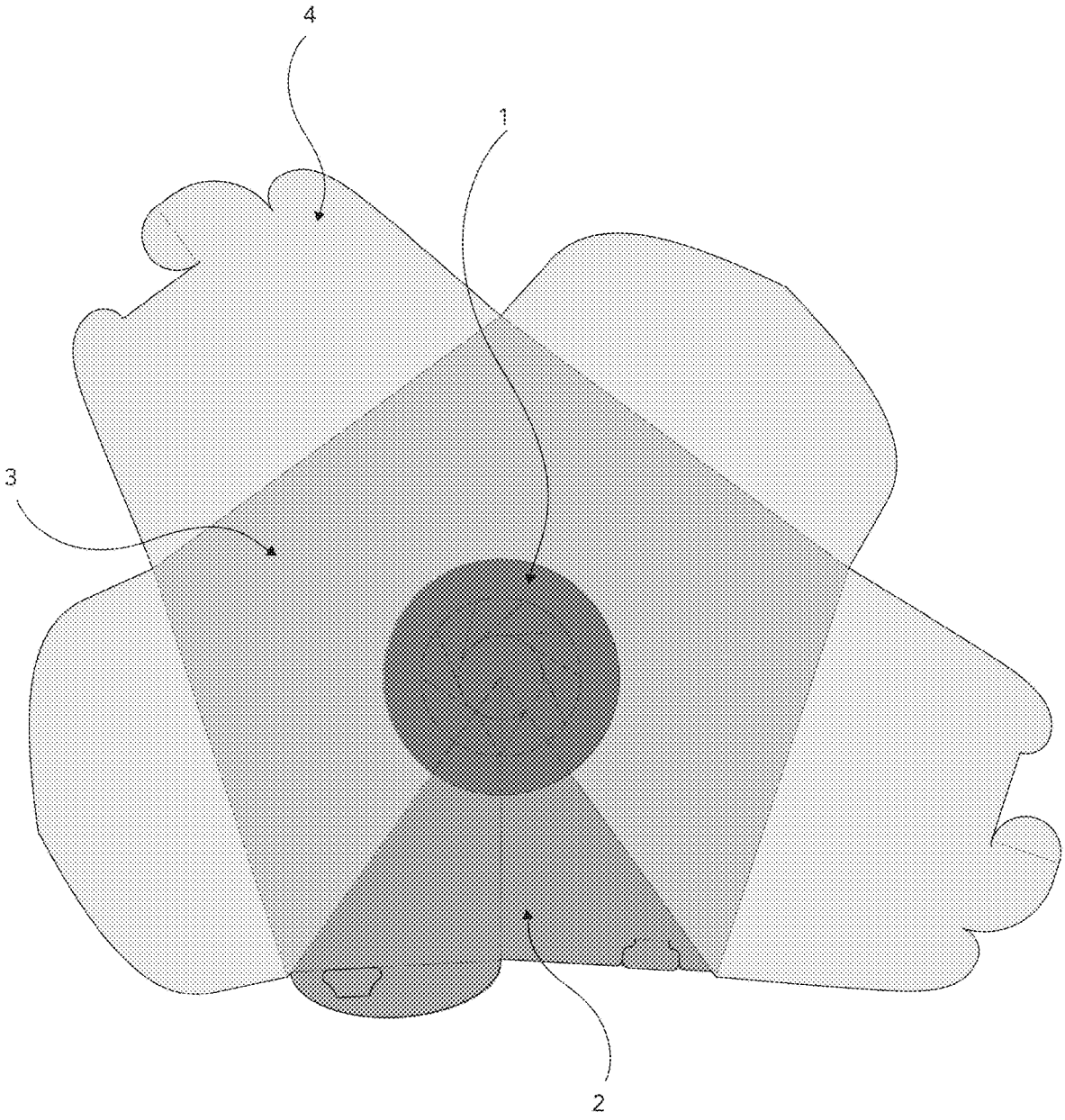
FIG. 1 is a plan view indicating packaging areas

In each figure, key parts are indicated according to this unique list of features.

1. Circular base of double concentric cone.
1.1 External border of the circular base (external circle)
1.2 Base crest (middle circle)
1.3 Internal border of the base (internal circle)
1.4 Engraved lines for crest formation
2. Overlap triangle
2.1 Engraved V outline
2.2 Middle crest (triangle axis)
2.3 Help fold
2.4 Flap
2.5 Flap slot
2.6 Holding fin
3 Container body
3.1 Geometric outline
4. Container lid system
4.1*a* First primary closing fin
4.1*b* Second primary closing fin
4.2*a* First secondary closing fin
4.2*b* Second secondary closing fin
4.3 Flap
4.4 Closing guides
4.5 Primary handle fin
4.6 Handle
4.7 High volume fin
4.8 Closing structural rim
4.9 Notch for rim locking As used in this application the term "engraved" means a line or shape that is embedded into the material in such a way that the material can be folded on the engraved line. In some instances, the engraved line is just an indentation in the material. In other embodiments, the engraved line may include perforations such as a dashed line in the material. A "foldable laminate container" described here relates to a container that is manufactured in a flat configuration, but which a user can fold into a three-dimensional container in the form of a bowl.

The present invention relates to a foldable packaging container. FIG. 1 is a plan view of one embodiment of the foldable packaging container indicating the main areas of the container: 1. a circular base of double concentric cone, that can be used for holding liquids; 2. an overlap triangle that facilitates folding and erecting the box; 3. a container body, which form the box upon folding the overlap triangle; and 4. A container lid system.

The liquid retaining folded laminar container described in this application is designed in a foldable cold or heat pre-cut paper or plastic sheet. The packaging container is marked with engraved lines or cuts which enable the sheet to be folded into a packaging container and other functionality. The circular base is configured to fold and form a cone cavity truncated by a circular base of double concentric cone. The package container's sides close on in themselves to create a self-bearing square, or any other geometric, outline container with its own protection systems (lids). The packaging container requires assembly for use. During storage and transport the packaging container is not folded and occupies a minimum volume as it can be laid flat, which optimizes space in warehousing.

Its main features are a square, or geometric outline; when assembled, the container's outline is square or geometric.

The container has a "central cone" that folds on itself, making it possible to reduce the container size and increase the container volume at the same time. This truncated cone series forms the base increasing strength for transport. The sides of the container overlap for fluid retention. The folding system prevents openings or open overlaps through which liquids flow decanting in the pack base. The container has high volume capacity self-bearing lids.

In some embodiments, the container has four top fins whose basic purpose is to close the container and protect the content. The fins can be set with some variations to turn into handles to carry the container, overlapping and ensuring each other. The lids can be closed in a flush manner to optimize container stacking. The lids may also be raised to contain products that require more volume. The lids are part of the container and close the cavity flush. Lids with handles can be fastened and facilitate transport.

Some embodiments comprise lids with the option to keep cutlery or small sauce containers.

The container, in some embodiments, is made from a sheet of paper of not less than 200 g with a factory or plasticized coating, or a sheet of plastic or other flexible material, submitted to a cold or heat pre-cut process. Once the outline, and necessary engraved finishes and cuts are marked, the pre-formed container is finished. As this design adheres to the same conventional box printing and pre-cut systems, it is easily applicable to the mass consumption industry.

The container can be folded manually in a manual or mechanical manner without requiring any additional elements, either adhesive or mechanical, outside of the design to keep the container assembled and the respective lid system.

The central cone volume, can be pushed down to create the double cone container portion in the base.

Figures 2, 3:
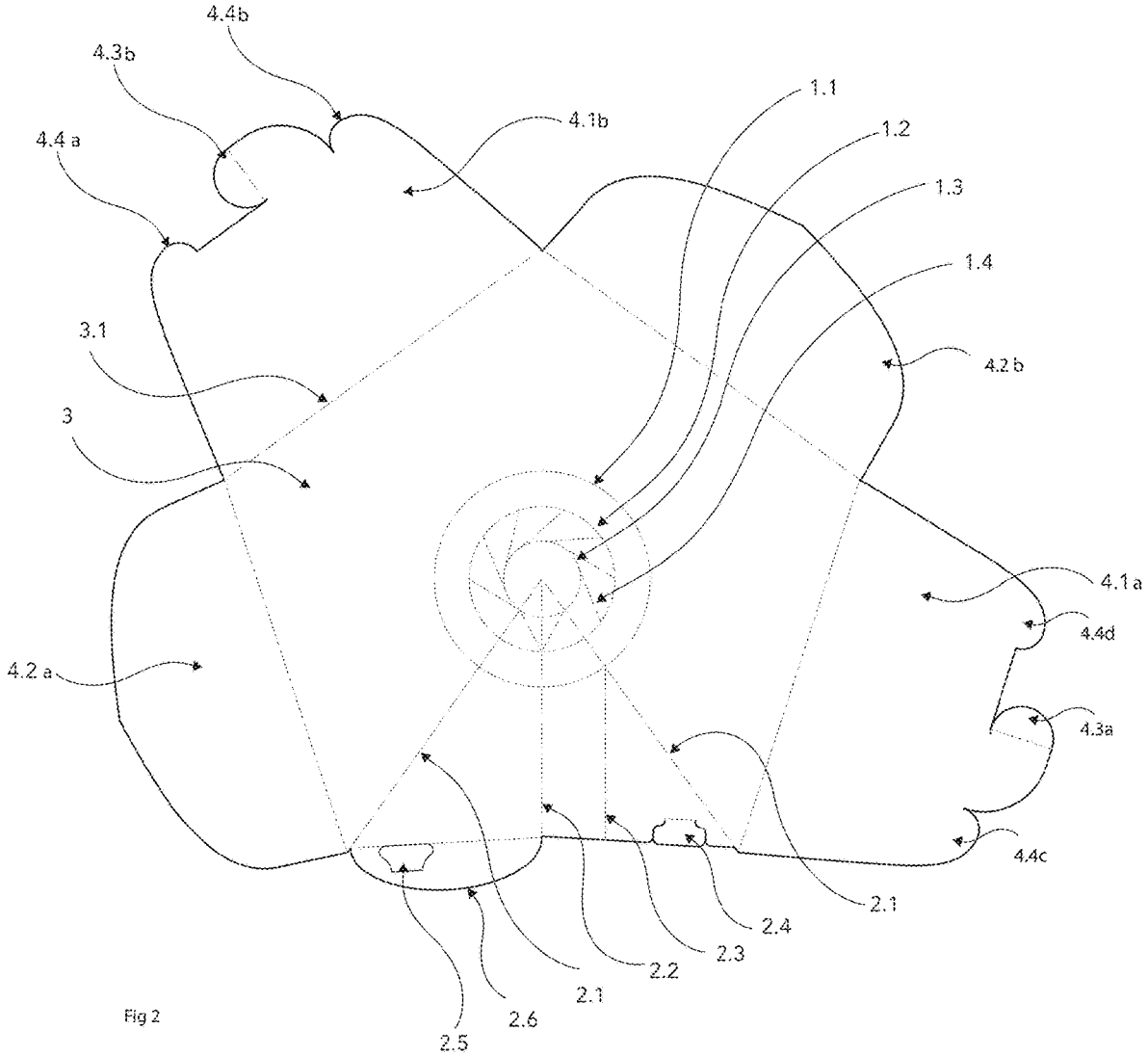
FIG. 2 is a plan view detailing parts and packaging areas.
FIG. 3 is a top view of the opened container.

As shown in FIG. 2, in one embodiment, the unfolded container is shown. The container has four major components, the circular base of double concentric cone (1); the overlap triangle (2), which allows the container to be folded; the container body (3), which is the area of the flat container outside the circular base (1); and the container lid system (4).

The circular base (1) has four components. The external border of the circular base-external circle (1.1), which is the outside border of the double cone. The base crest-middle circle (1.2), which is the top of the first ridge of the double cone once formed. The internal border (1.3) of the base-inner circle, which is the inside depression of the circular base (1). Between the base crest (1.2) and the internal border (1.3), engraved lines (1.4) or cuts are found that facilitate the double cone to be formed once the container is folded.

The container contains an overlap triangle (2). The overlap triangle (2) is designed allow the flat sheet to be folded into a three-dimensional container. The overlap triangle (2) consists of an engraved V outline (2.1) that extends radially from the center of the external border (1.1) of the circular base (1). The engraved V outline (2.1) forms a engraved overlap triangle, where two of the sides are the engraved V outline (2.1) and the one side is an edge of the geometric outline (3.1). A middle crest (2.2) extends from the apex of the engraved V outline (2.1) to an edge of the geometric outline (3.1). The container may also include one or more help folds (2.3) that extend from one of the edges of the engraved V outline (2.1) to the edge of the geometric outline (3.1). The container also includes a flap (2.4) and a flap slot (2.5), which can be used to secure the container in shape, once it is folded. The container also includes a holding fin (2.6) that extends away from the edge of the geometric outline (3.1) where the engraved V outline (2.1) is located. The holding fin (2.6) assists in folding the container onto a three-dimensional container.

Figure 6:
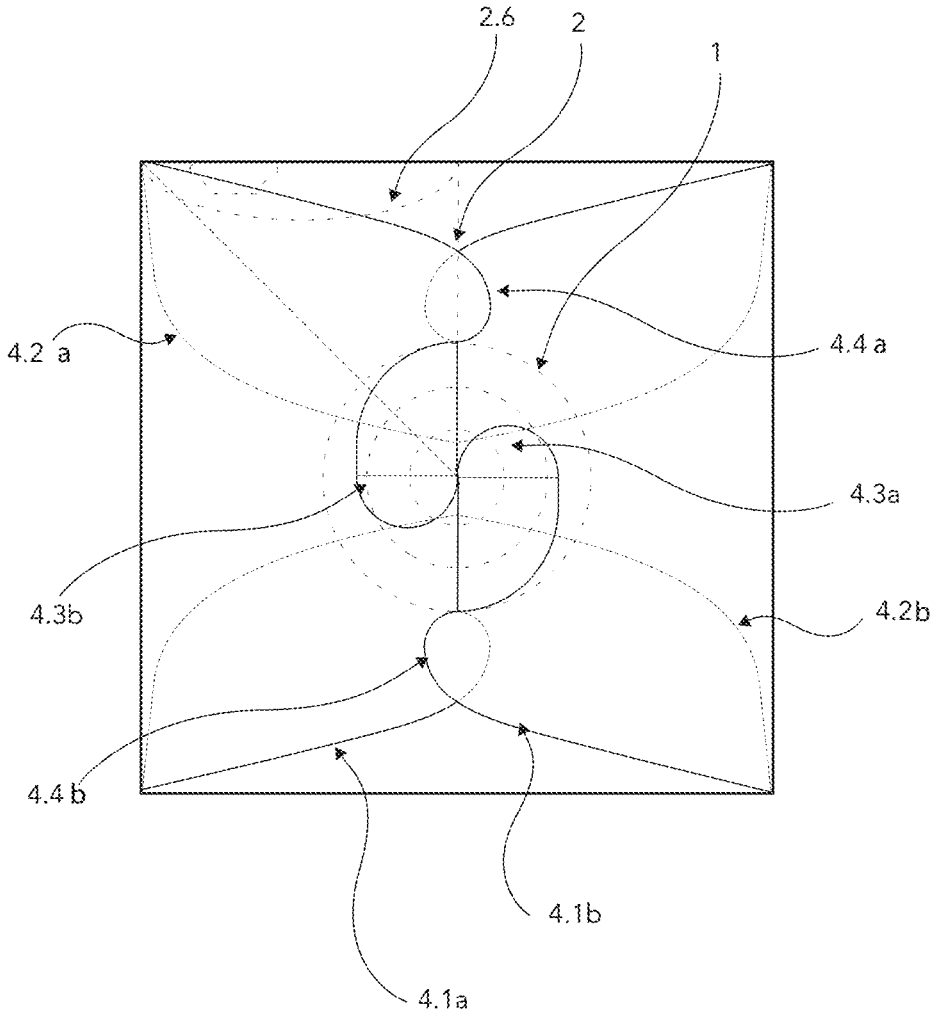
FIG. 6 is a plan view of an assembled/folded and closed model.
Figure 12:
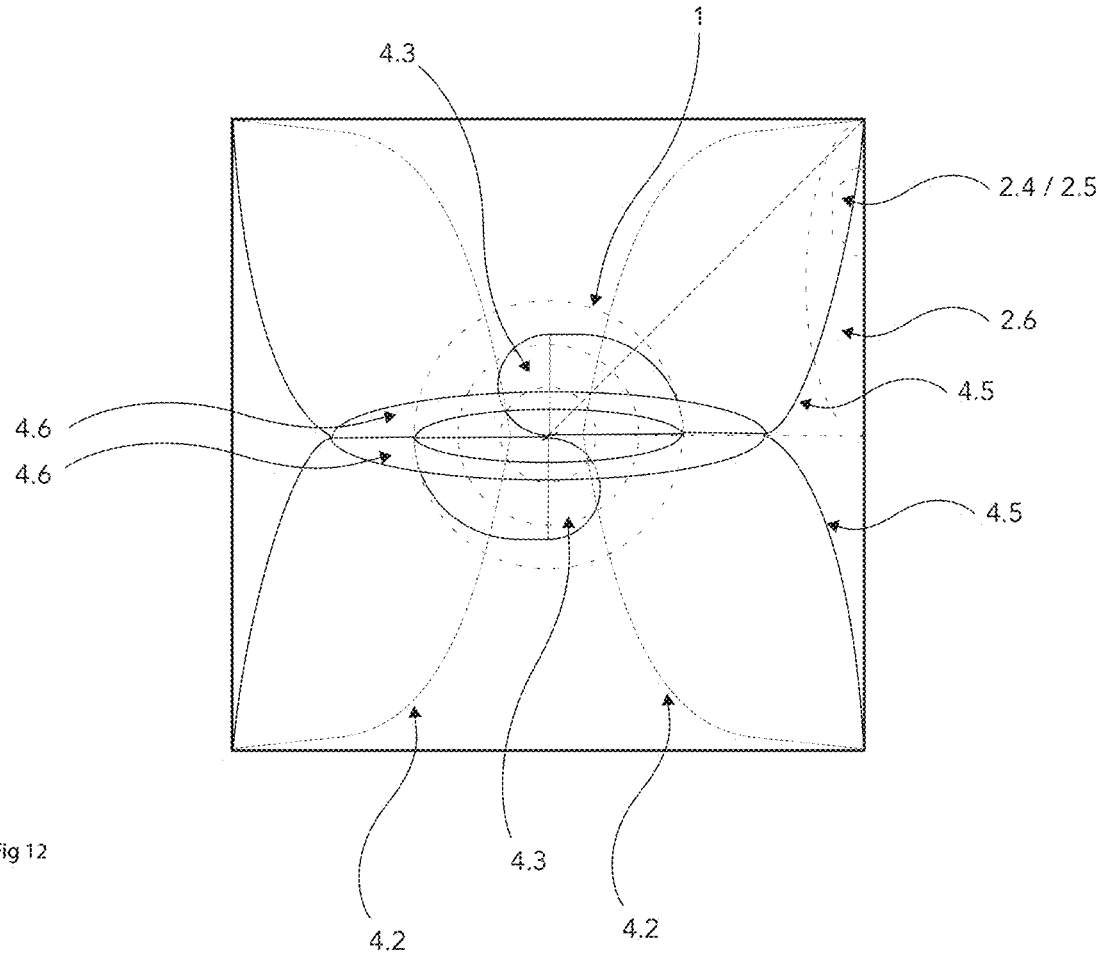
FIG. 12 is a plan view of closed assembled/folded handled model.
Figure 13:
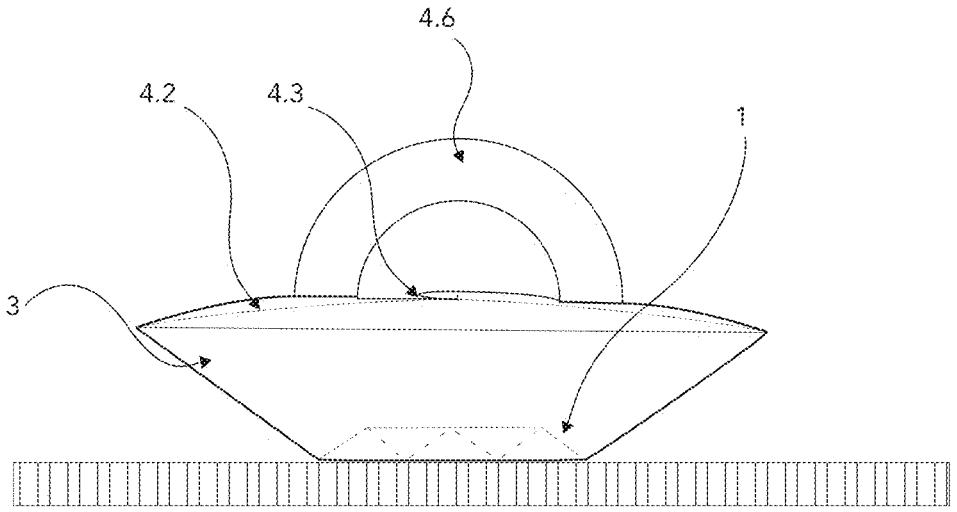
FIG. 13 is a side view of closed assembled/folded handled model.
Figures 14, 15:
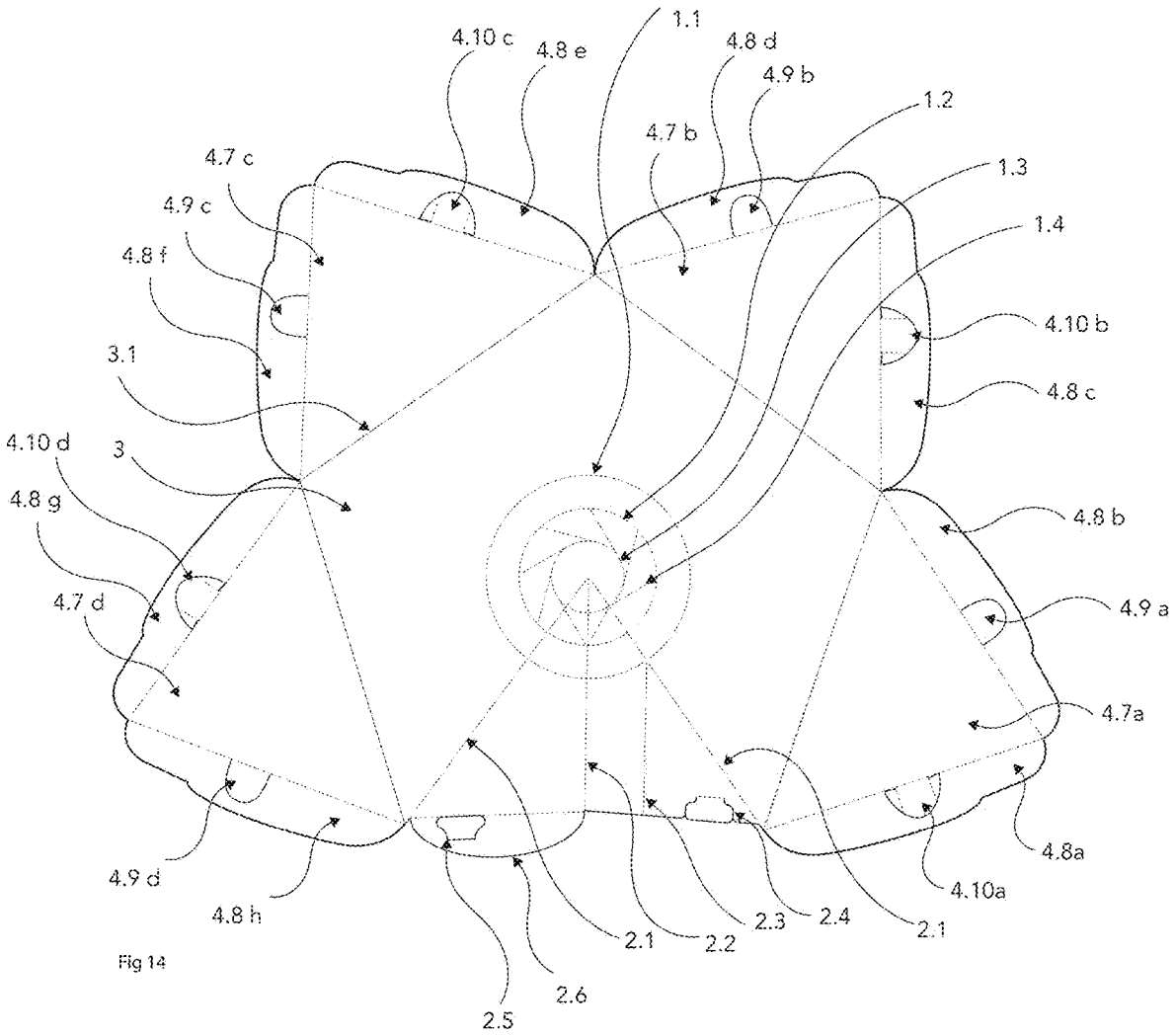
FIG. 14 is a plan view of non-assembled/un-folded high volume model.
FIG. 15 is a side view of non-assembled/un-folded high volume model.
Figure 16:
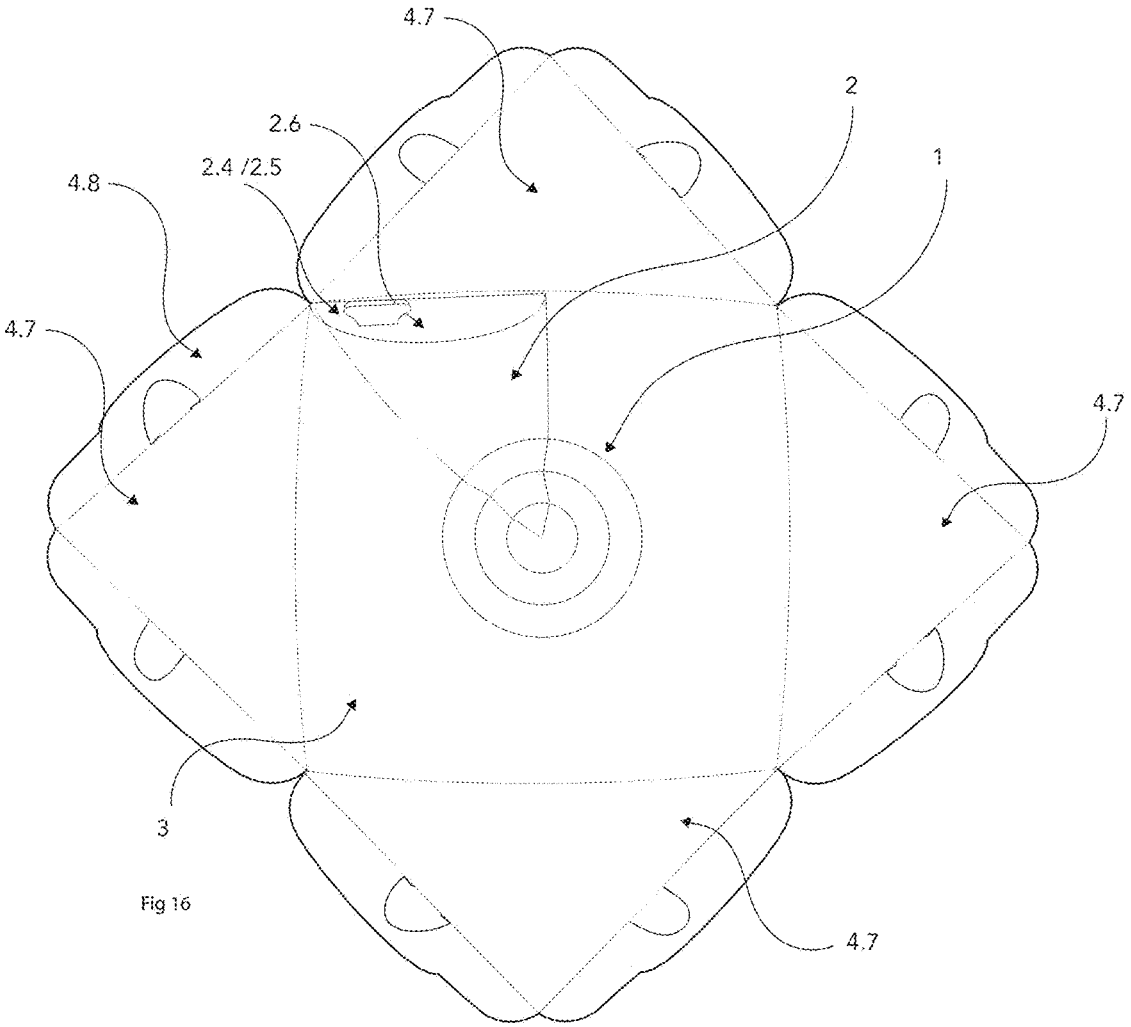
FIG. 16 is a plan view of open assembled/folded high volume model.
Figure 17:
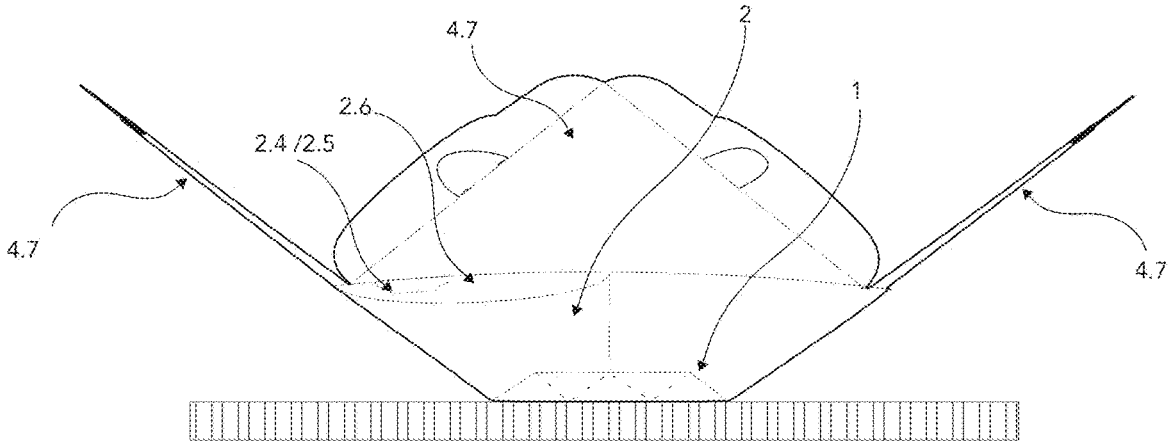
FIG. 17 is a side view of open assembled/folded high volume model.
Figure 18:
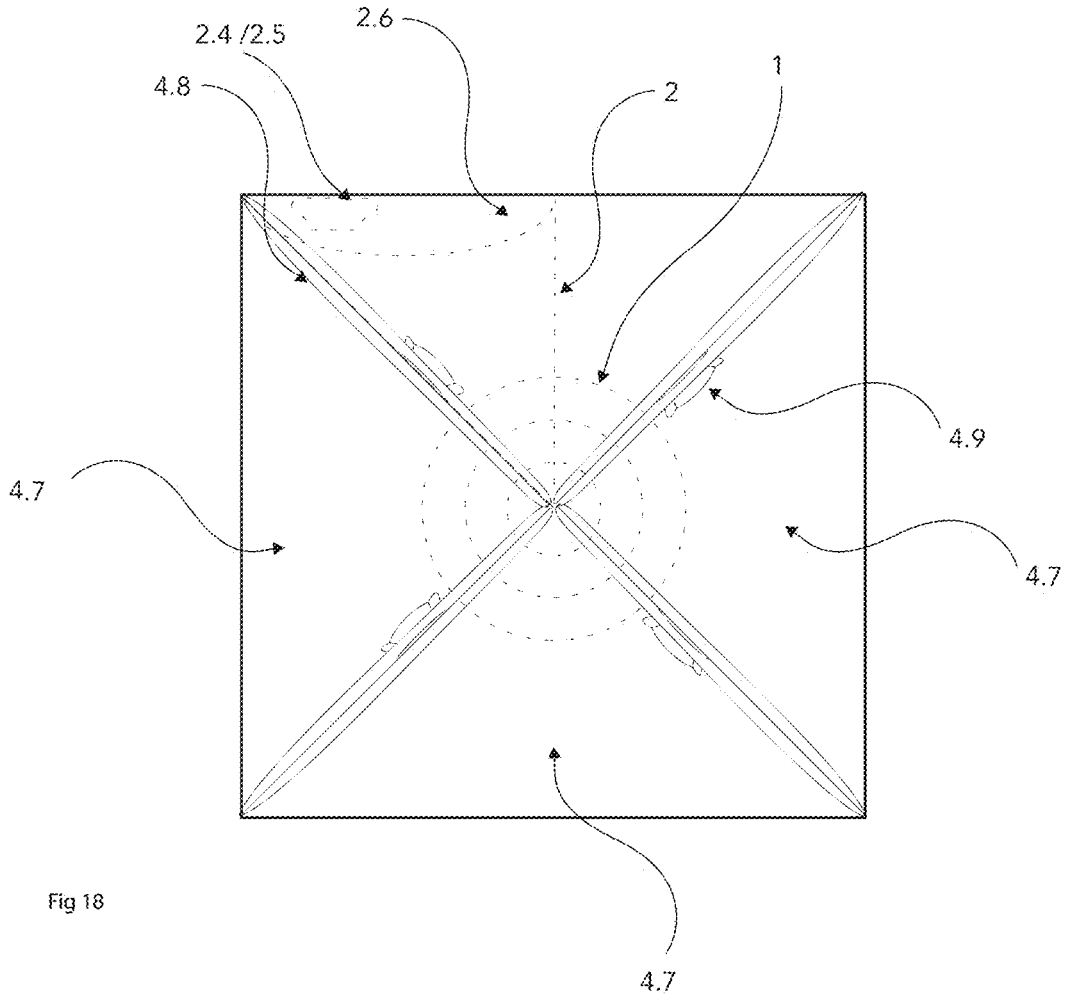
FIG. 18 is a plan view of closed assembled/folded high volume model.
Figure 19:
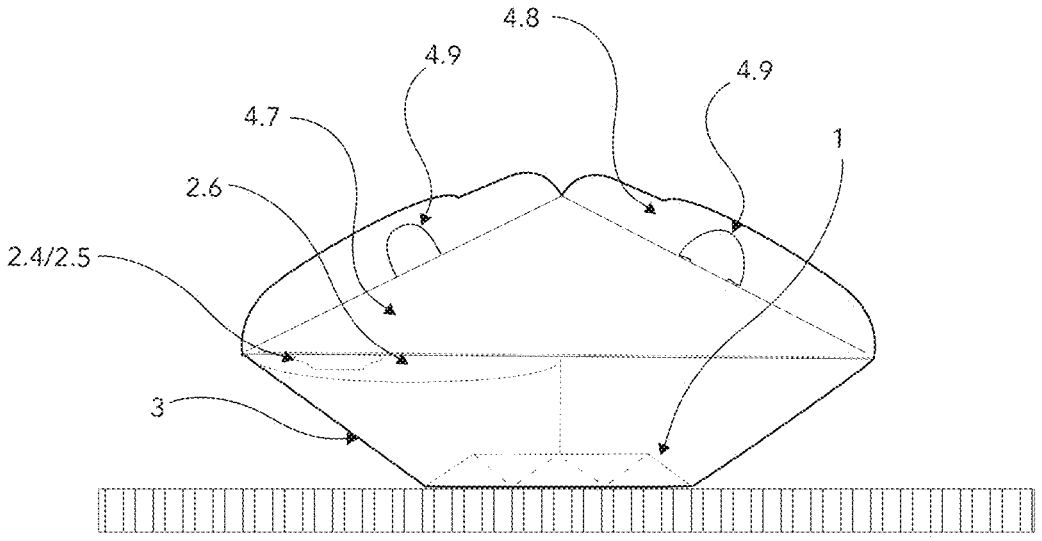
FIG. 19 is a side view of closed assembled/folded high volume model.
Figure 20:
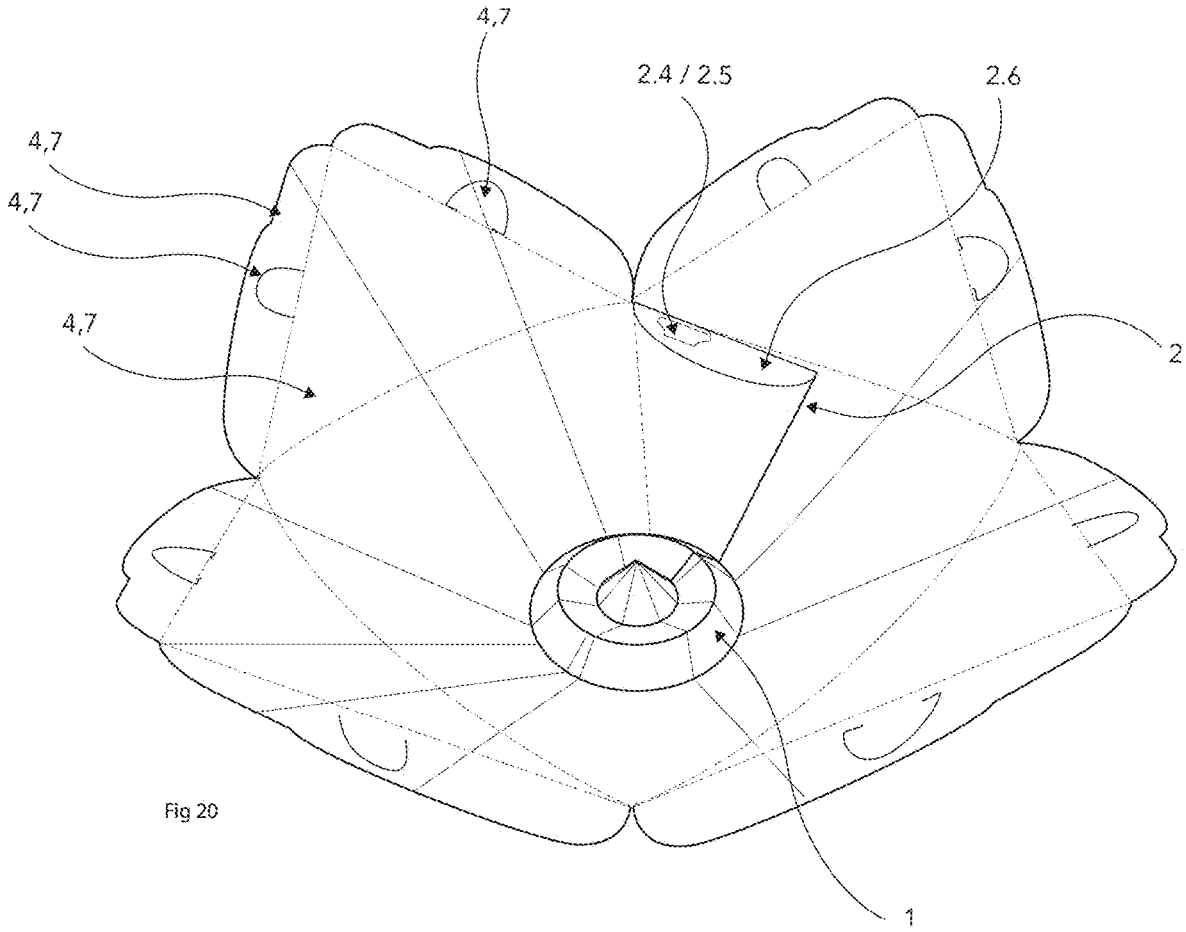
FIG. 20 is an isometric view of open assembled/folded high volume model.
Figure 21:
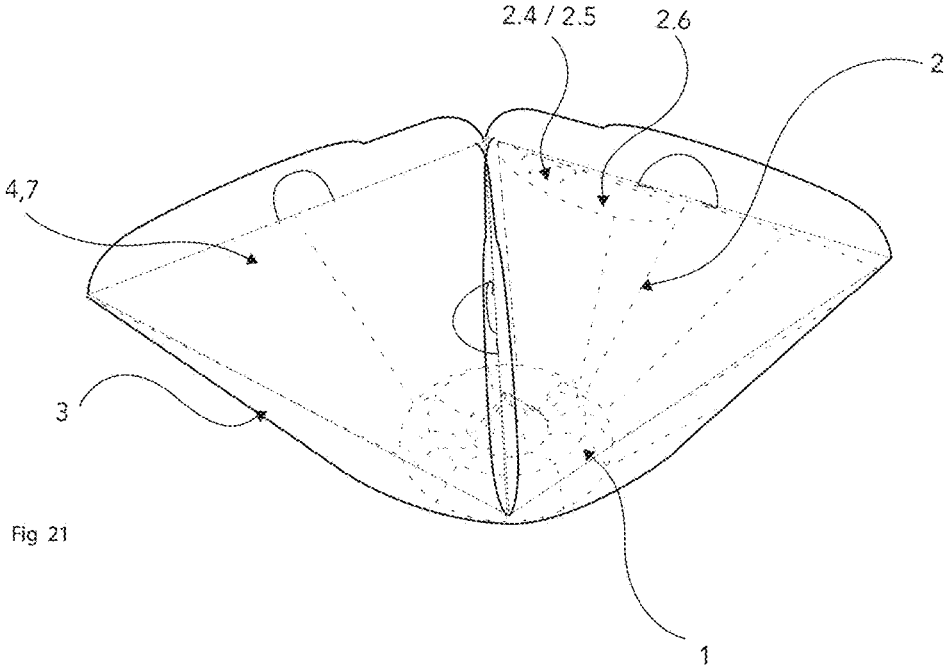
FIG. 21 is an isometric view of closed assembled/folded high volume model.

The container further includes a container body (3) which has a geometric outline (3.1) engraved into the container body (3). In some instances the geometric outline (3.1) is in the form of a pentagon, in others it may be a hexagon, or another polygonal shape. The shape of the geometric outline (3.1) will result on the shape of the top border of the container once it is folded from the container's flat configuration. The resulting container will have the number of borders that is one less than the geometric outline (3.1) shape, depending on how the overlap triangle (2) is arranged. If the triangle has a base that extends the entire base of one of the sides of the geometric outline (3.1), then the resulting container will have one less side than the number sides of the container. However, if the overlap triangle (2) has a base that is only part of one of the sided of the geometric outline (3), the resulting container may have the same or more sides of the container. For example, when the geometric outline (3.1) is a pentagon, the resulting container, once folded, will have four distinct edges as shown in FIGS. 6, 12, and 18.

The container, may also include a container lid system (4). Each part of the lid system (4) extends away from each of the edges of the geometric outline (3.1). The lid system (4), in some embodiments, has a first primary closing fin (4.1*a*) and a second primary closing fin (4.1*b*) opposite to each other. A first primary closing fin (4.1*a*) extends away from the border of the geometric outline (3.1) adjacent to the border that includes the engraved V outline (2.1). The container also includes first secondary closing fins (4.2*a*) and a second secondary closing fin (4.2*b*) opposite to each other. The first secondary closing fin (4.2*a*) extends away from the geometric outline (3.1) adjacent to the border that includes the engraved V outline (2.1).

The primary closing fins (4.1*a* and 4.1*b*) have flaps (4.3*a* and 4.3*b*) that are opposite each other and can be used to secure the primary closing fins (4.1*a* and 4.1*b*) when closing the container. The primary closing fins (4.1*a* and 41.*b*) may also include closing guides (4.4*a*, 4.4*b*, 4.4*c*, and 4.4*c*).

Figure 4:
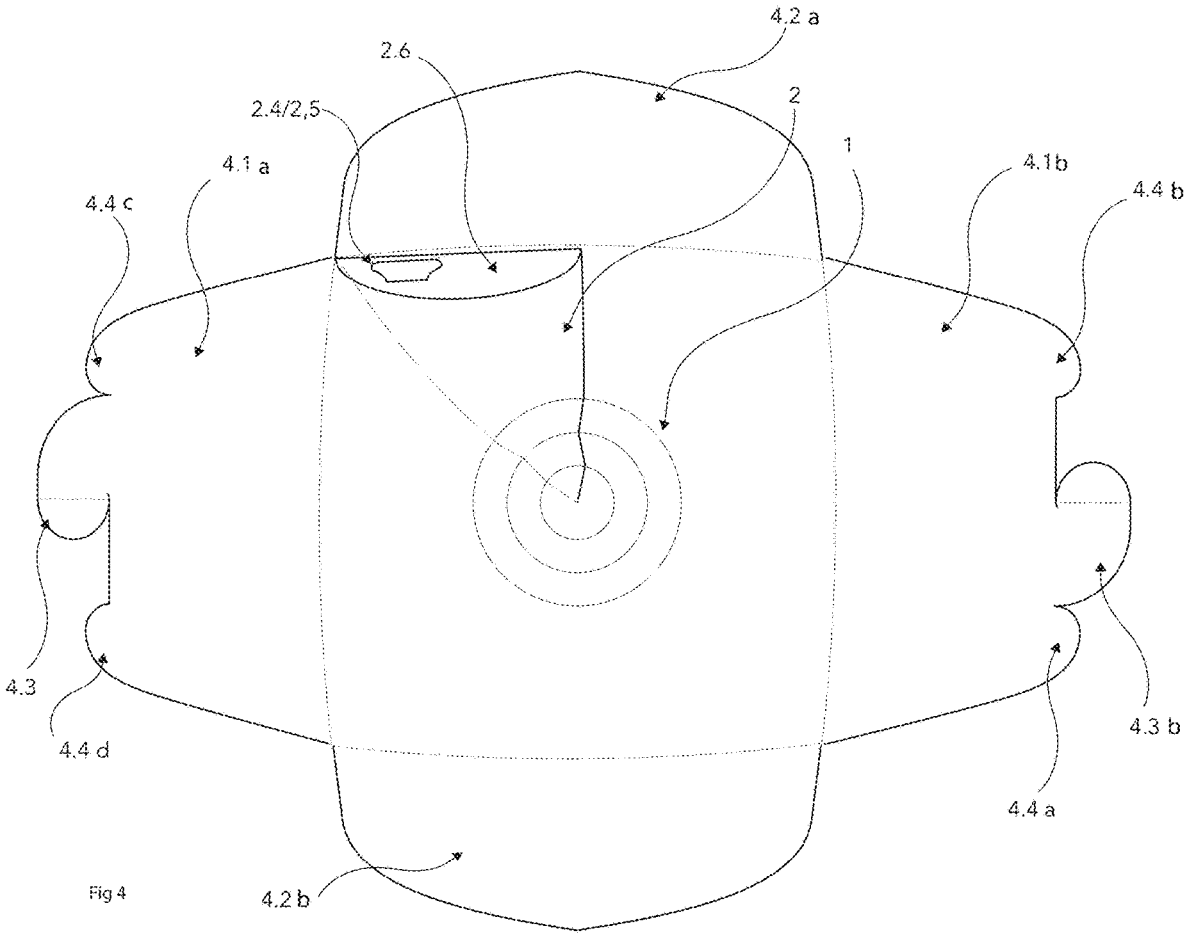
FIG. 4 is a plan view of an assembled/folded and open model.
Figure 5:
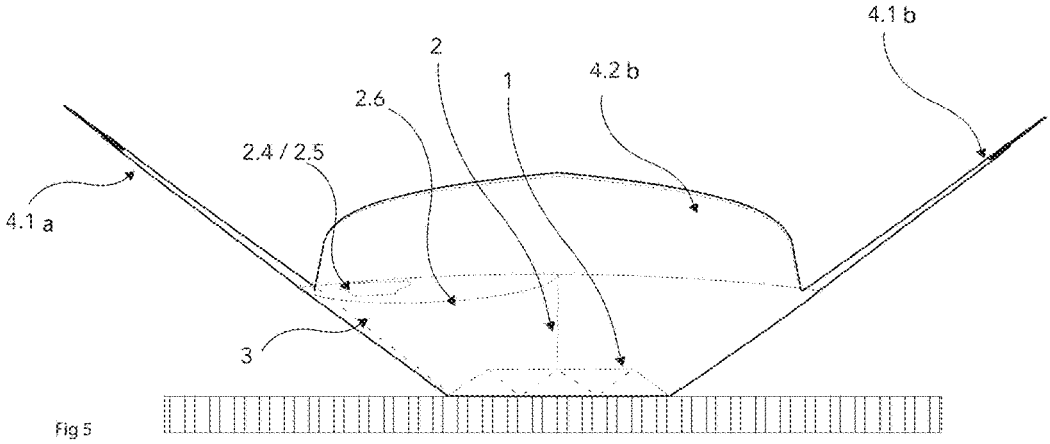
FIG. 5 is a side view of an assembled/folded and open model.

A top view of the opened container is shown in FIG. 4. The figure shows that when the overlap triangle (2) is folded in the container has four sides. The figure shows the holding fin (2.6) pointing to the inside of the container and the flap (2.4), which is in the flap slot (2.5). The secondary closing fins (4.2*a* and 4.2*b*) and the primary closing fins (4.1*a* and 4.1*b*) are open. FIG. 5 shows a side view of the same container where the dotted lines show the circular base of double concentric cone (1).

Figure 7:
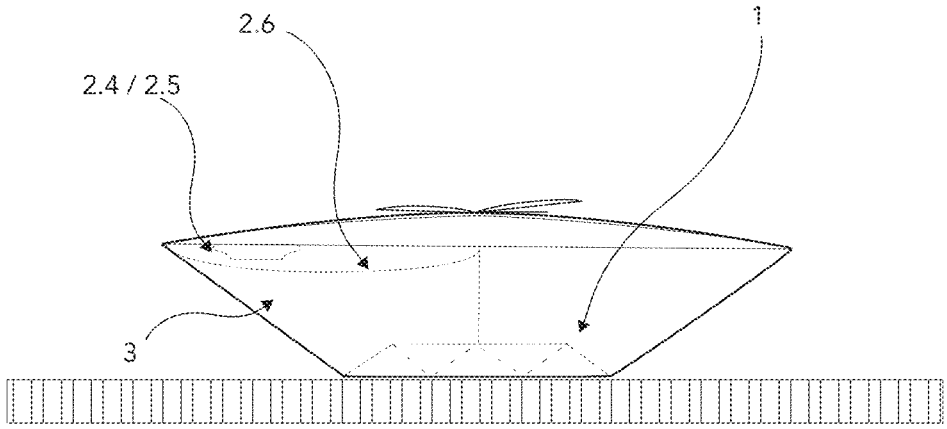
FIG. 7 is a side view of an assembled/folded and closed model.
Figures 8, 9:
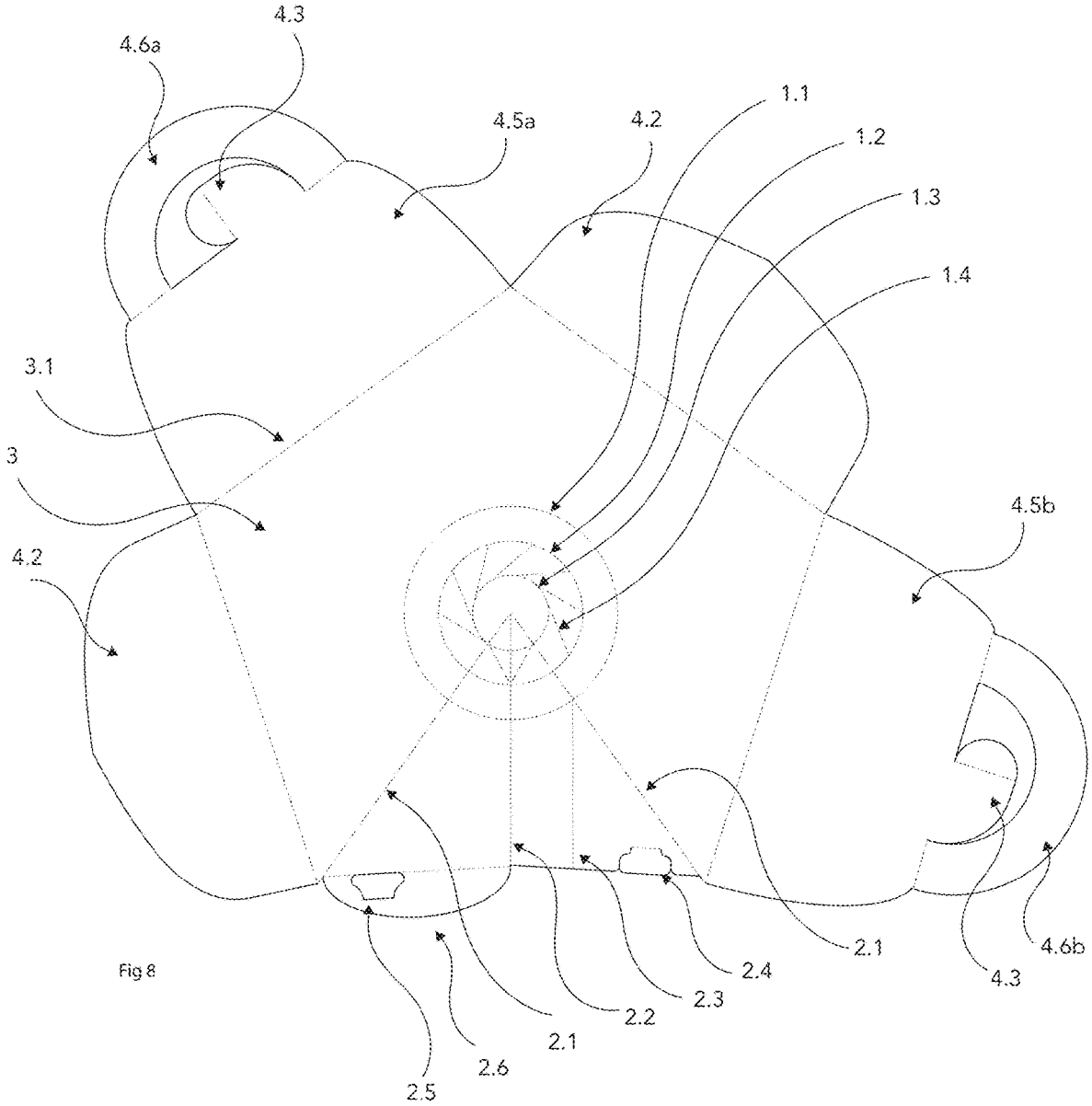
FIG. 8 is a plan view of non-assembled/un-folded handled model.
FIG. 9 is a side view of non-assembled/un-folded handled model.
Figure 10:
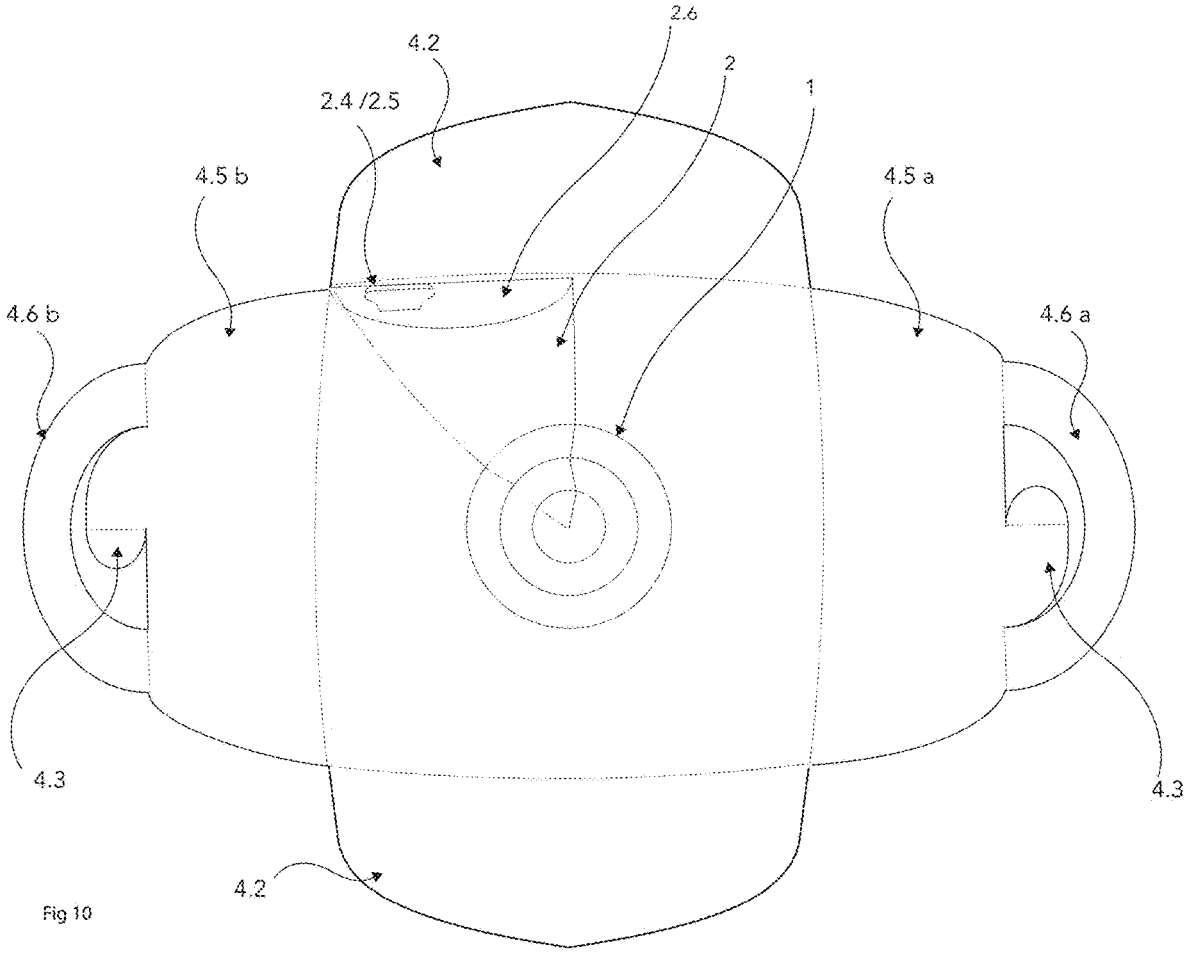
FIG. 10 is a plan view of open assembled/folded handled model.
Figure 11:
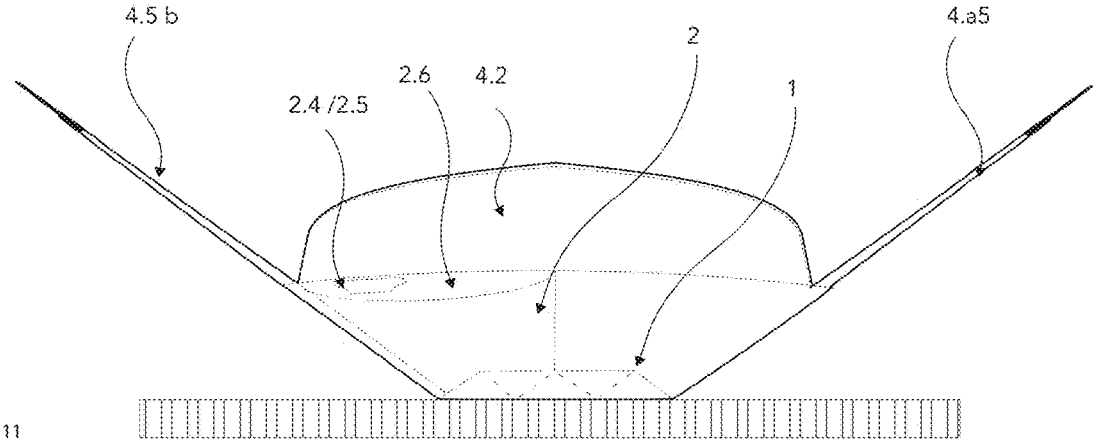
FIG. 11 is a side view of open assembled/folded handled model.

FIGS. 6 and 7 show the container in a closed configuration. The flaps 4.3*a* and 4.3*b* secure the primary closing fins 4.1*a* and 4.1*b* the closing guides 4.4*a*, 4.4*b*, 4.4*c*, and 4.4*d* are closed alternatively as shown.

FIGS. 8 through 13 shows the top view of the container, that further shows primary handles (4.6*a* and 4.6*b*). The primary handles (4.6*a* and 4.6*b*) connect to primary handle fins (4.5*a* and 4.5*b*).

FIGS. 14 through 21 show a high volume embodiment. The container has high volume fins 4.7*a*, 4.7*b*, 4.7*c*, 4.7*d*. Each high volume fin 4.7*a*, 4.7*b*, 4.7*c*, 4.7*d*, has a closing structural rim 4.8*a*, 4.8*b*, 4.8*c*, 4.8*d*, 4.8*e*, 4.8*f*, 4.8*g*, 4.8*h*, and notch for rim locking 4.9*a*, 4.9*b*, 4.9*c*, 4.9*d* and locking tabs 4.10*a*, 4.10*b*, 4.10*c*, and 4.10*d*.

Figures 22, 23:
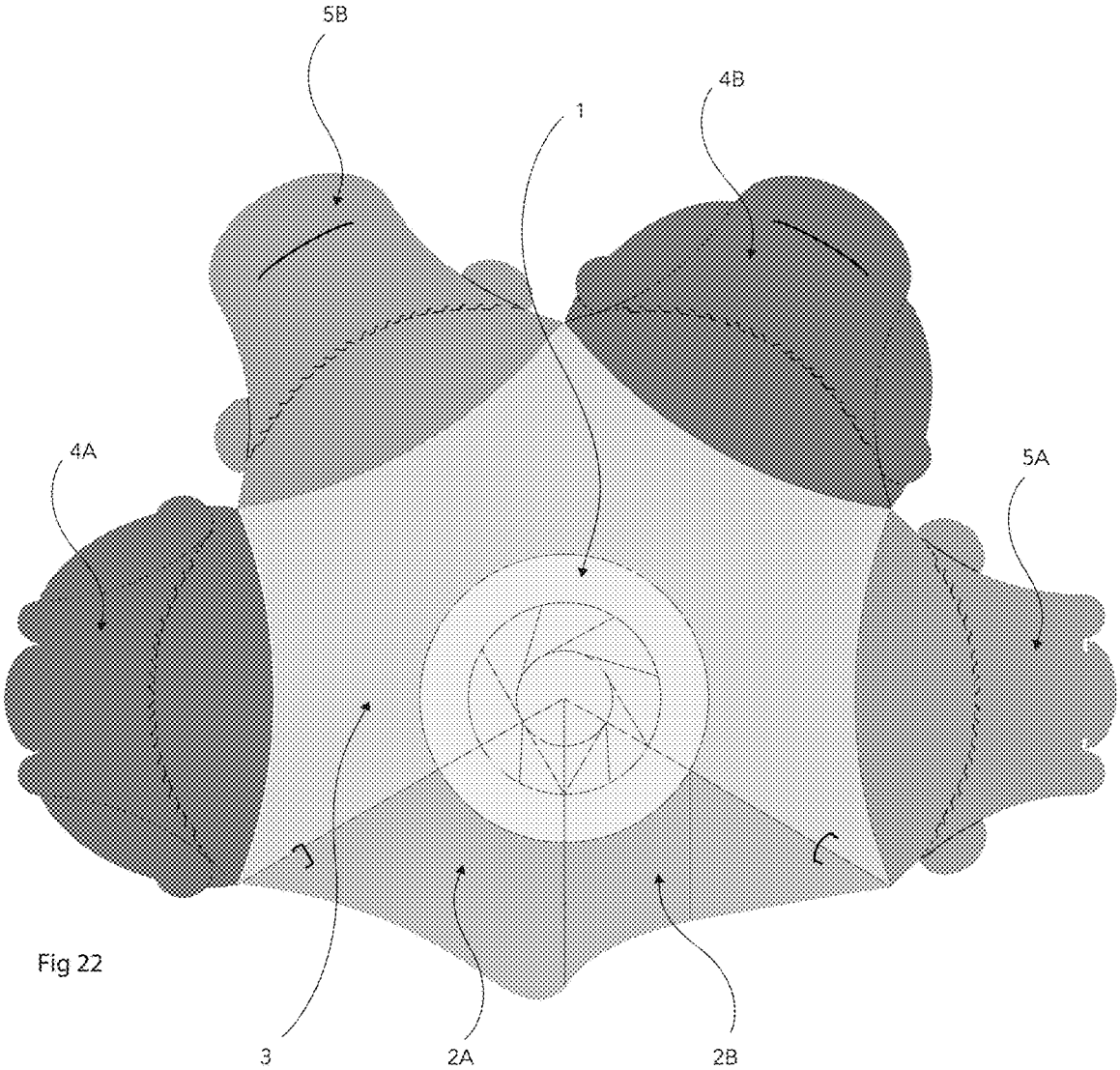
FIG. 22 is a plan view of a stylized container.
FIG. 23 is a side view of a non-assembled/un-folded stylized container.

FIGS. 22 and 23 show planar views of another embodiment, in which the geometric outline (3.1) is a hexagonal or irregular form. The primary closing fins (4.1*a* through 4.1*d*) have a stylized form. The hexagonal/irregular forms provides further strength to the container once the flat container is assembled/folded into a complete container. As discussed above, the folding the cone through the engraved V outline (2.1). Like the other embodiments, the fold allows the circular base (1) to create a double concentric cone.

Figure 24:
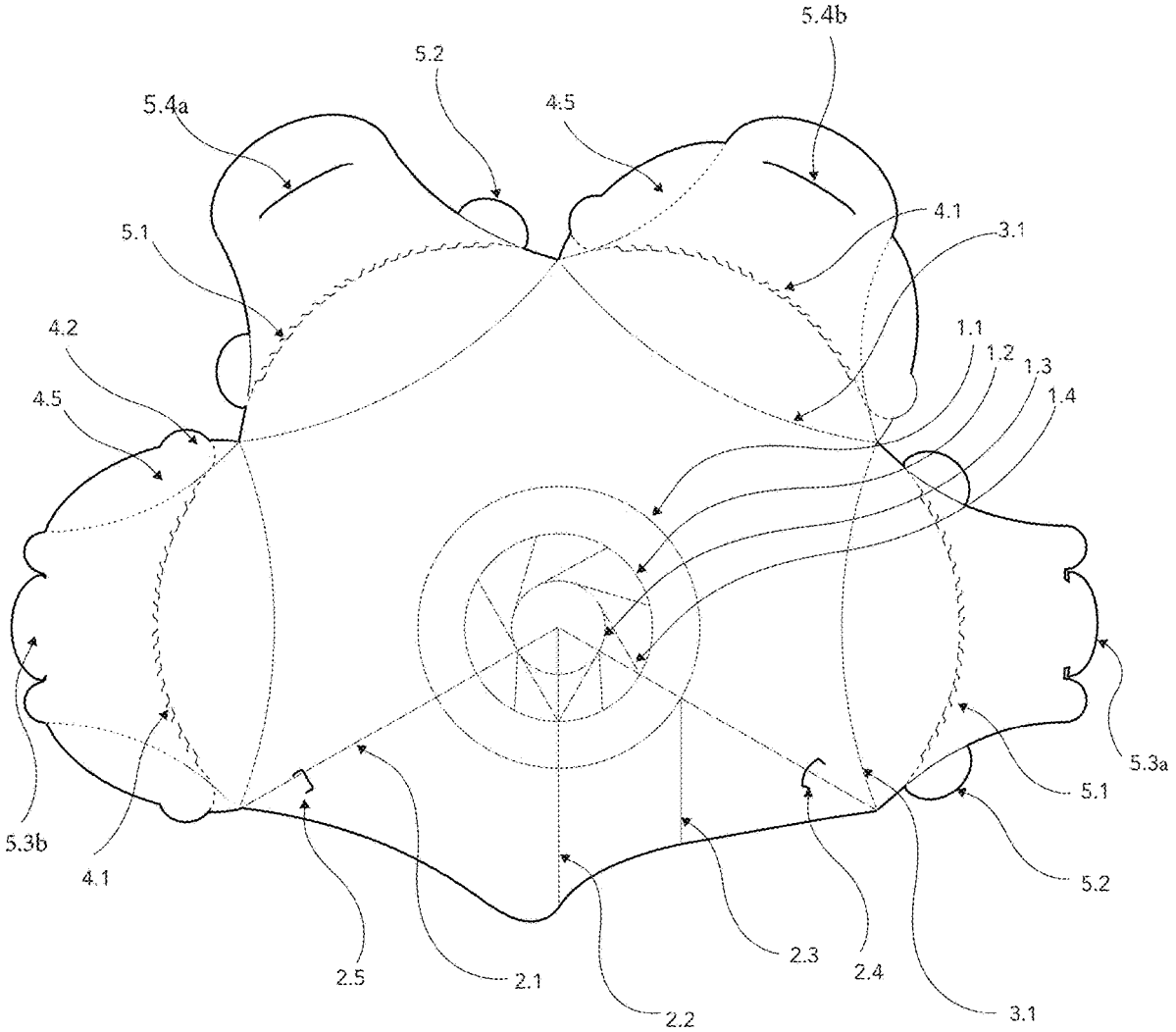
FIG. 24 is a plan view of a non-assembled/un-folded stylized container detailing parts and packaging areas.
Figure 25:
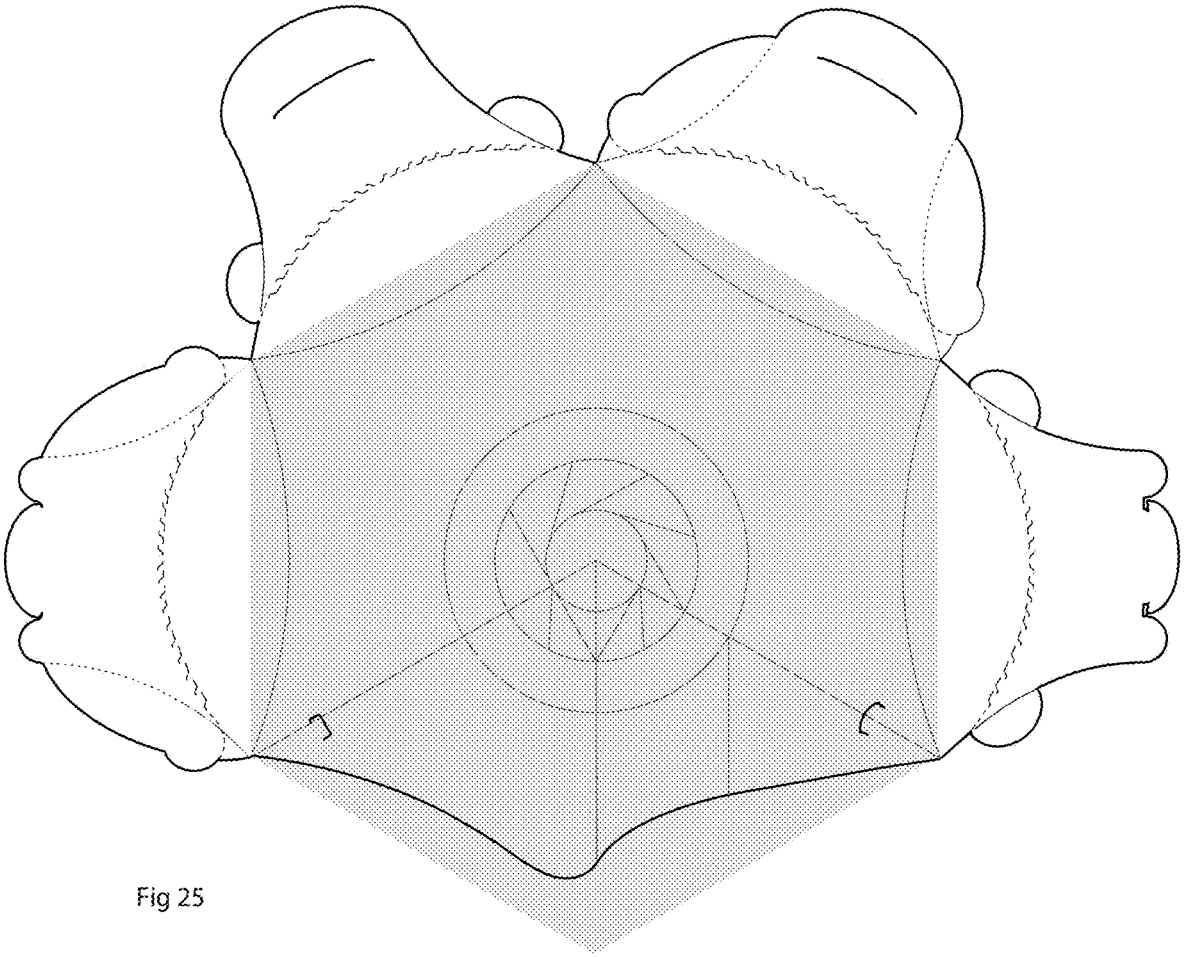
FIG. 25 is a plan view of an un-assembled/un-folded stylized container shading the content.
Figure 26:
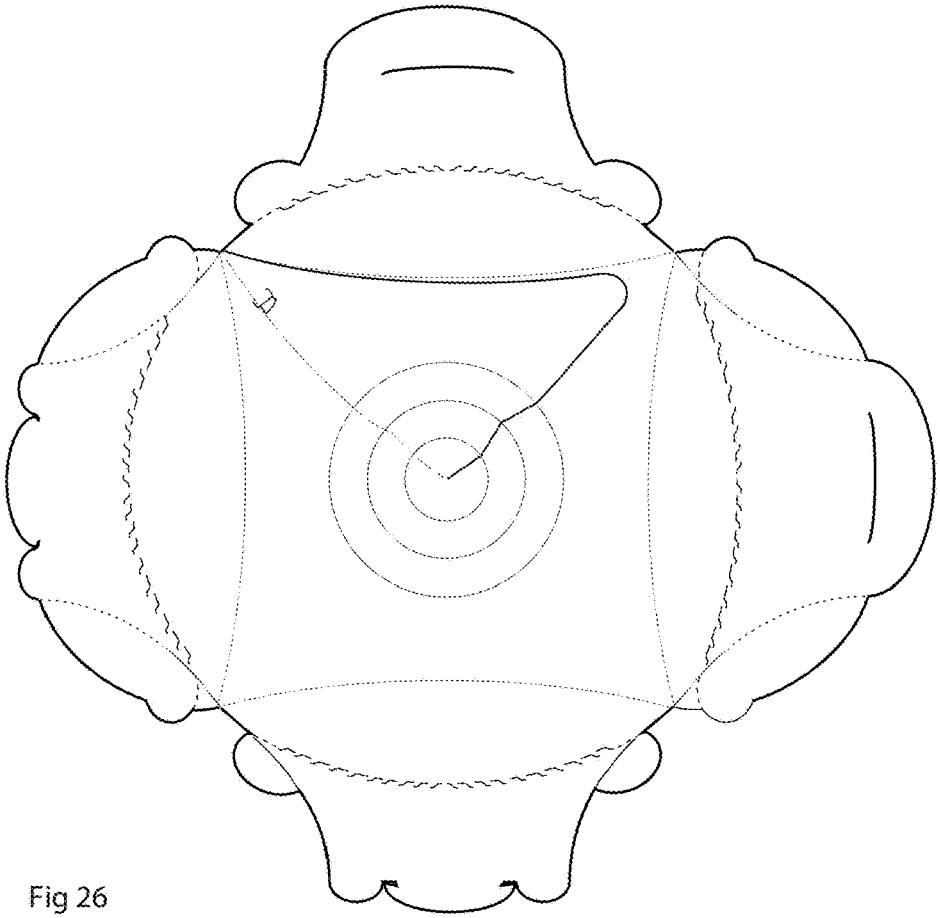
FIG. 26 is a top view of an assembled/folded stylized container.
Figure 36:
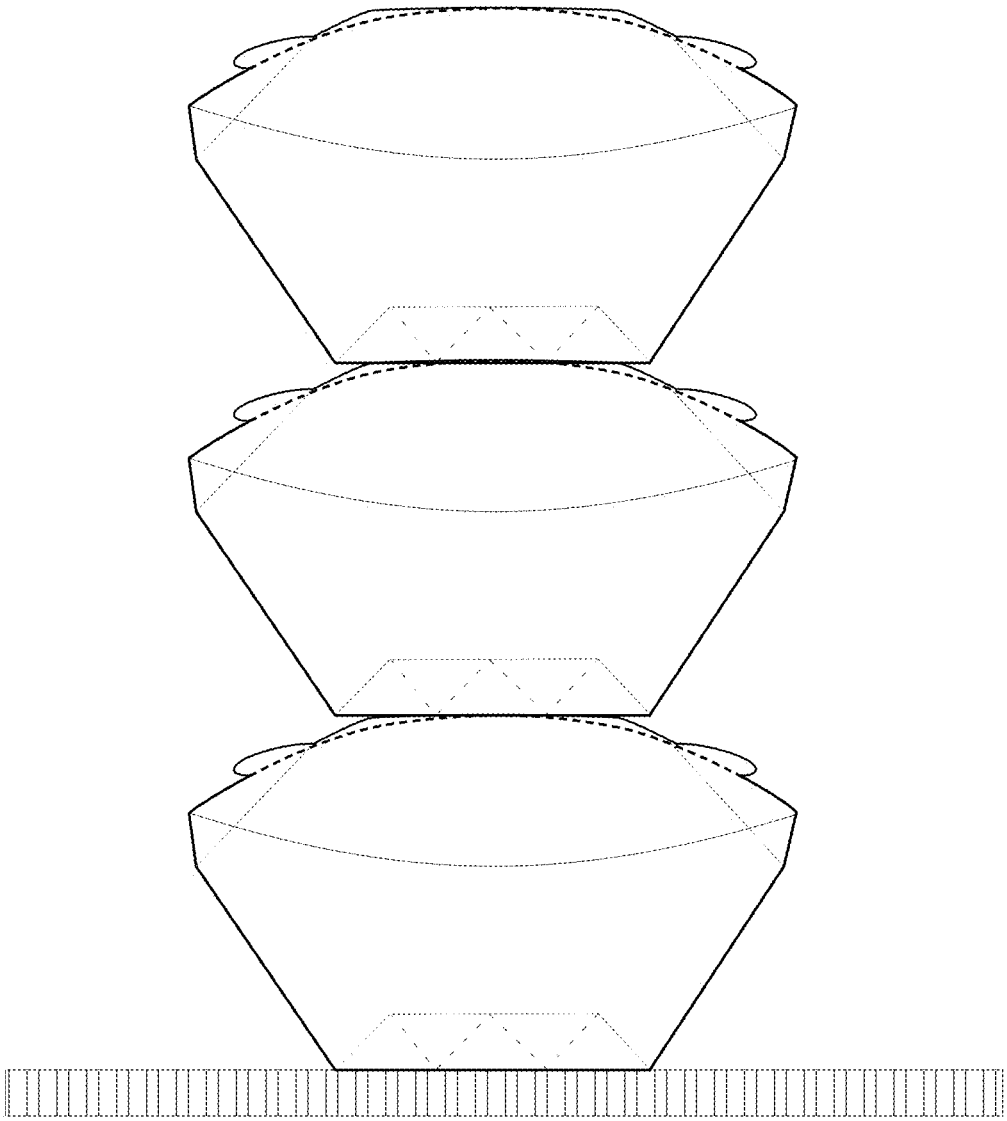
FIG. 36 is a side view that shows multiple containers that are stackable.
Figure 37:
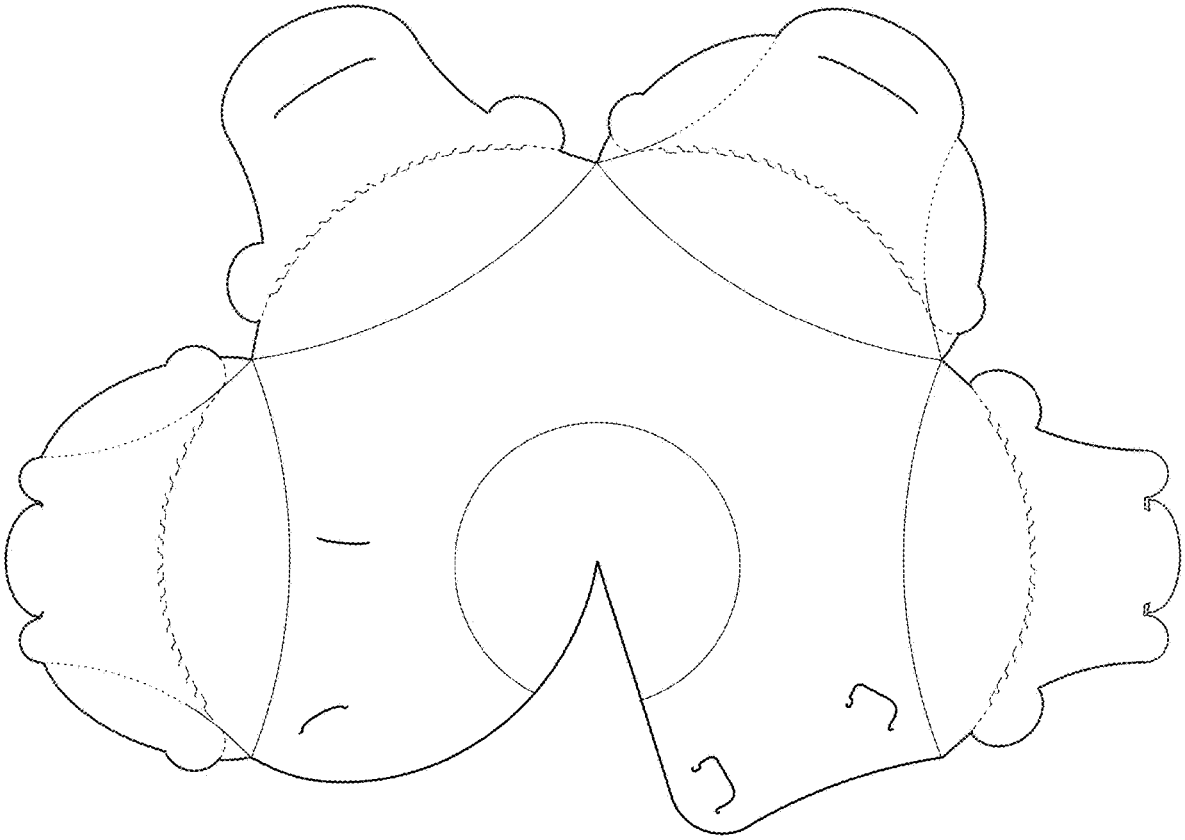
FIG. 37 is a plan view of an un-assembled/un-folded further stylized container.
Figure 38:
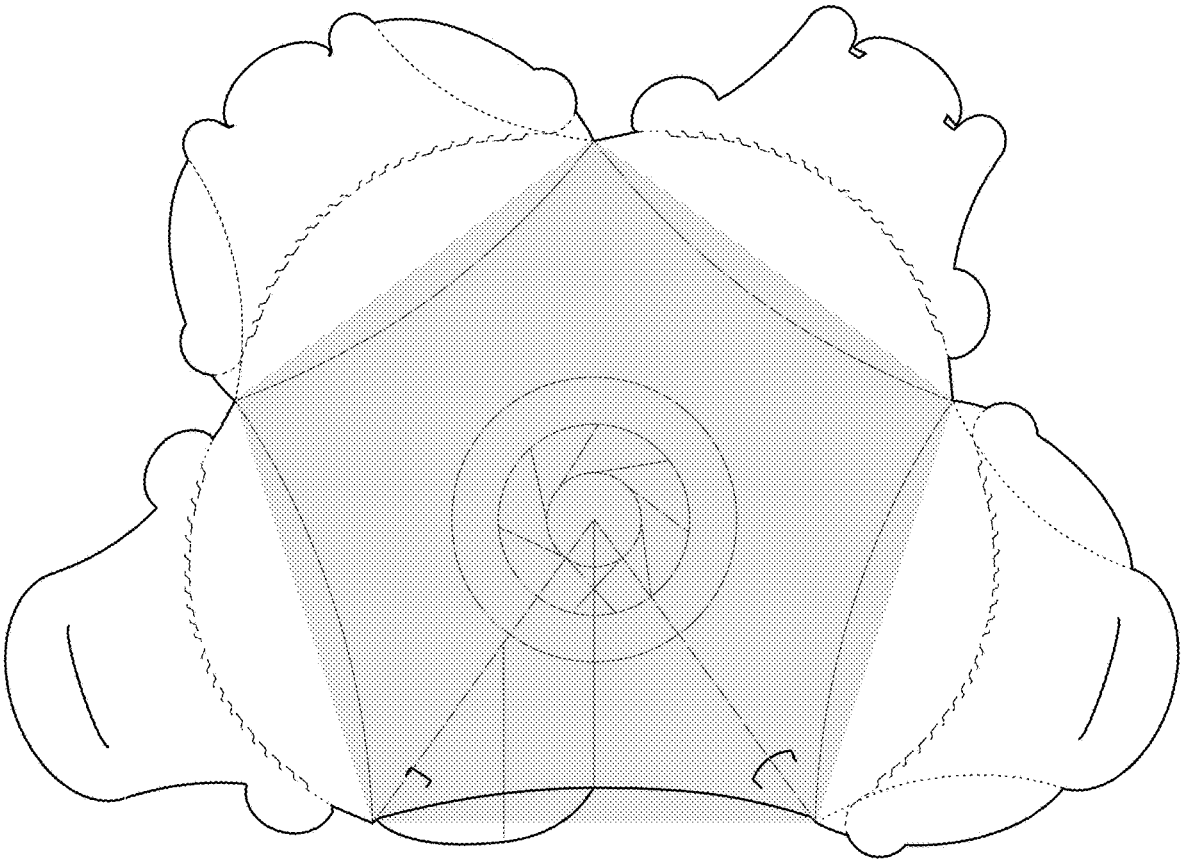
FIG. 38 is a plan view of another un-assembled/un-folded stylized container.

As shown in FIGS. 24 and 26 the edges of the geometric outline (3.1) are rounded towards the center of the container. The container also includes additional engraved lines that mirror the rounded edges of the geometric outline and may be perforated. In this configuration, once the folded container is formed and the closing fins are in place, the rounded outlines form a semi-vertical or vertical wall and allow the top of the closing fins to sit flat and allow for multiple containers to be stacked one on top of another as shown in FIG. 36.

Figure 27:
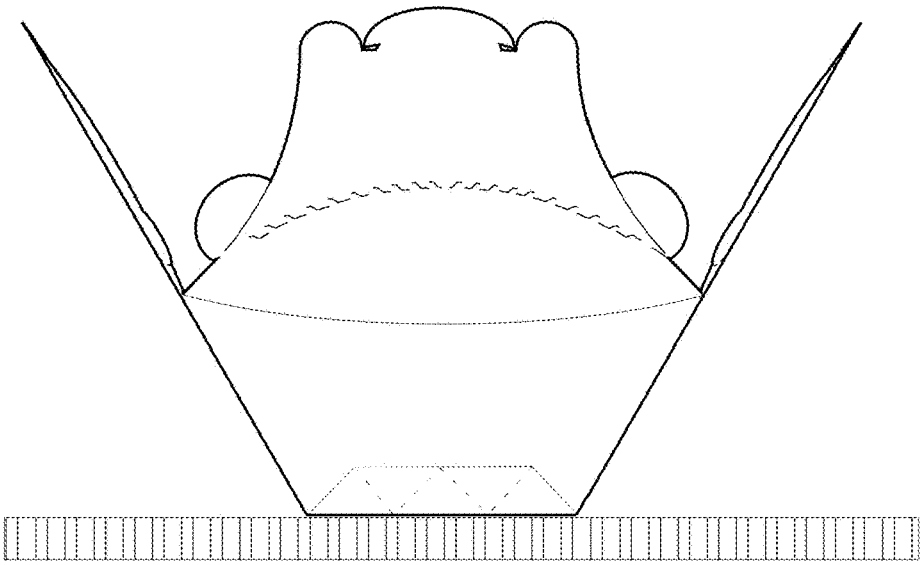
FIG. 27 is a side view of an open assembled/folded stylized container.
Figure 28:
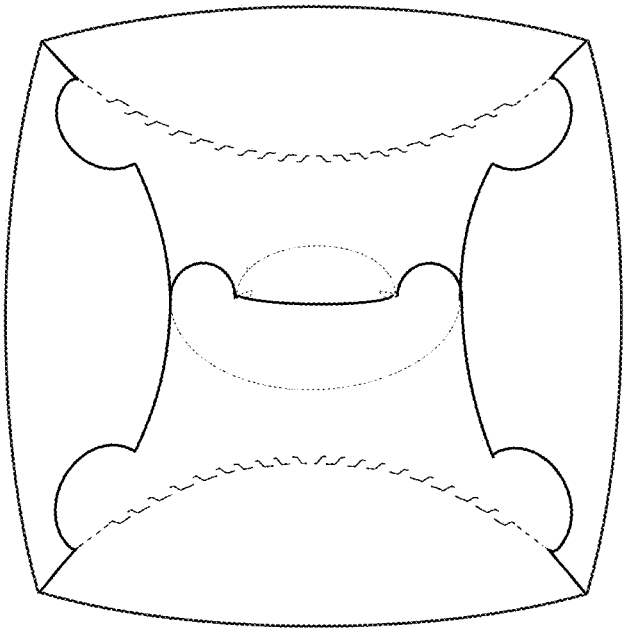
FIG. 28 is a top view of a closed assembled/folded stylized container.
Figure 29:
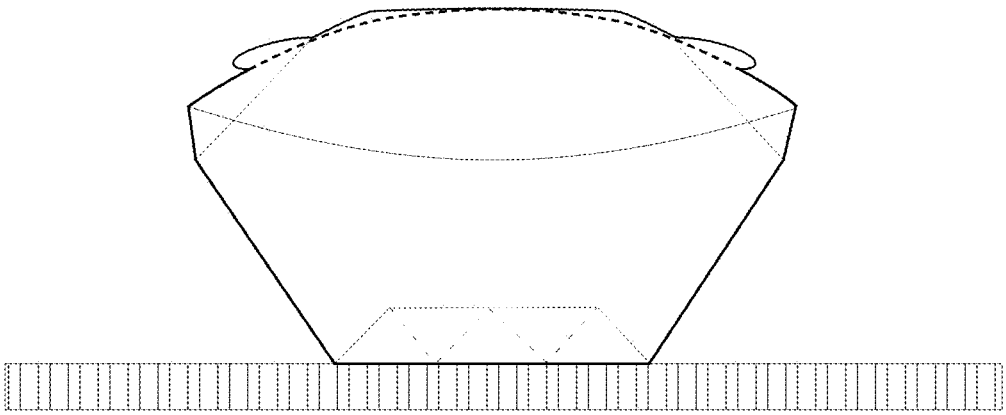
FIG. 29 is a side view of a closed assembled/folded stylized container.
Figure 30:
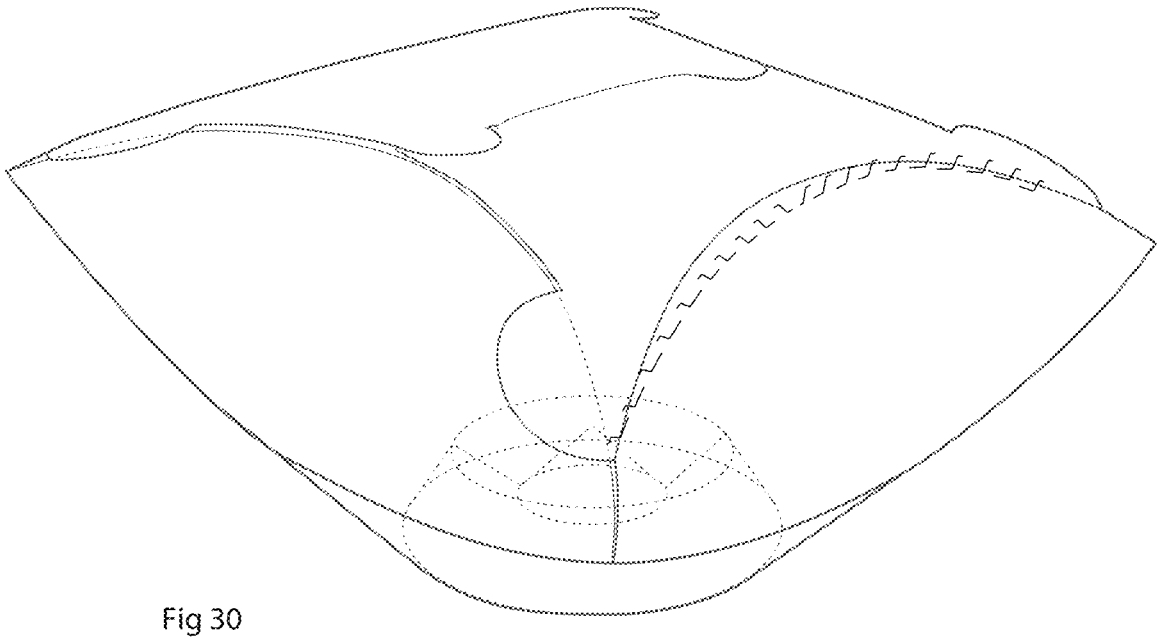
FIG. 30 is a perspective view of a close assembled/folded stylized container.

As shown in FIGS. 26 and 27 *a* the flaps and the closing fins include perforated outlines. The perforated outlines can be used to remove any of the flaps or closing fins as desired.

FIG. 26 shows the engraved V outline folded to form the container. FIG. 26 further shows a flap (2.4) and flap slot (2.5) that is used to secure the fold of the engraved V outline.

Figure 31:
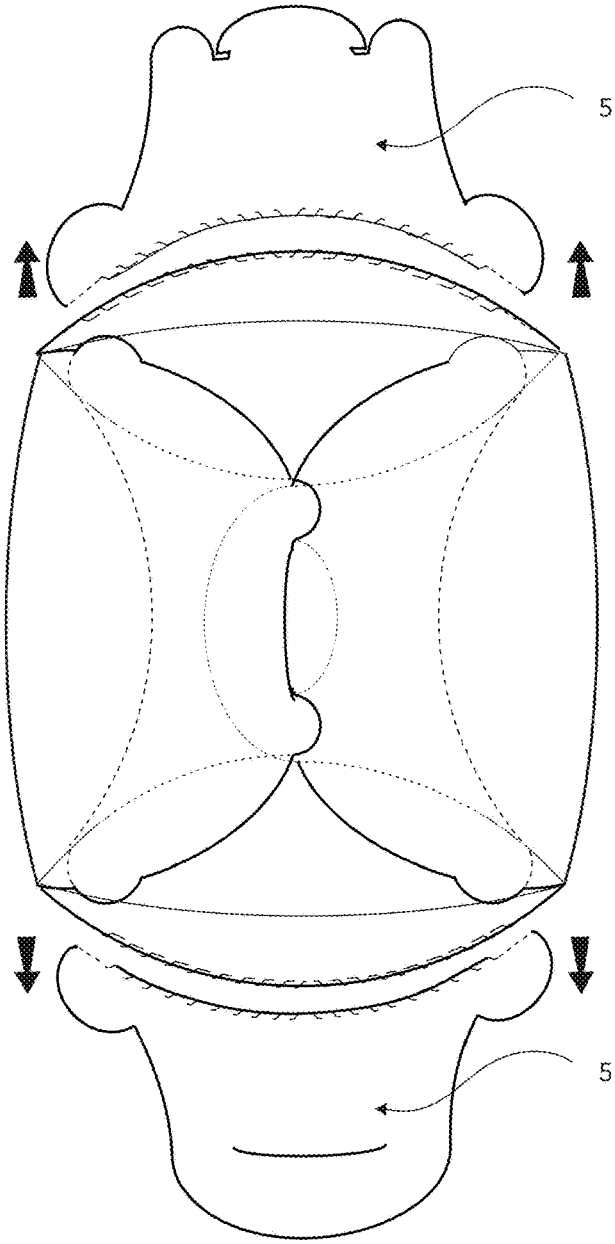
FIG. 31 is a top view of a closed assembled/folded stylized container, showing how the closing fins configured to be ripped from the container.
Figure 32:
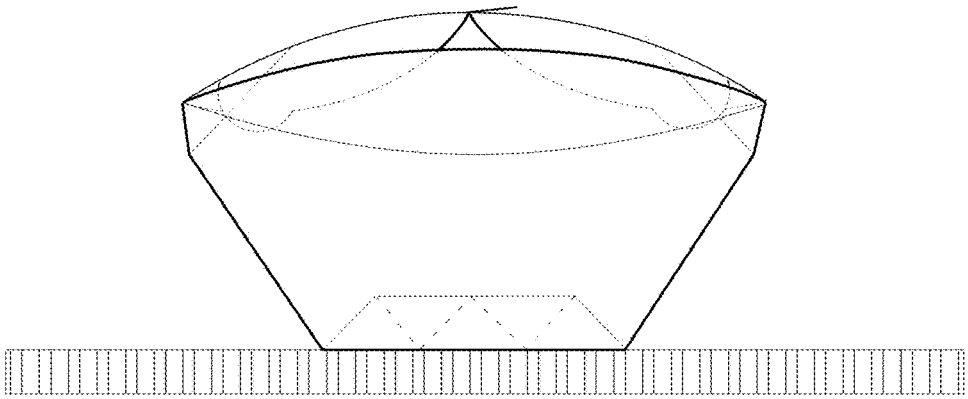
FIG. 32 is a side view of a closed assembled/folded stylized container.
Figure 33:
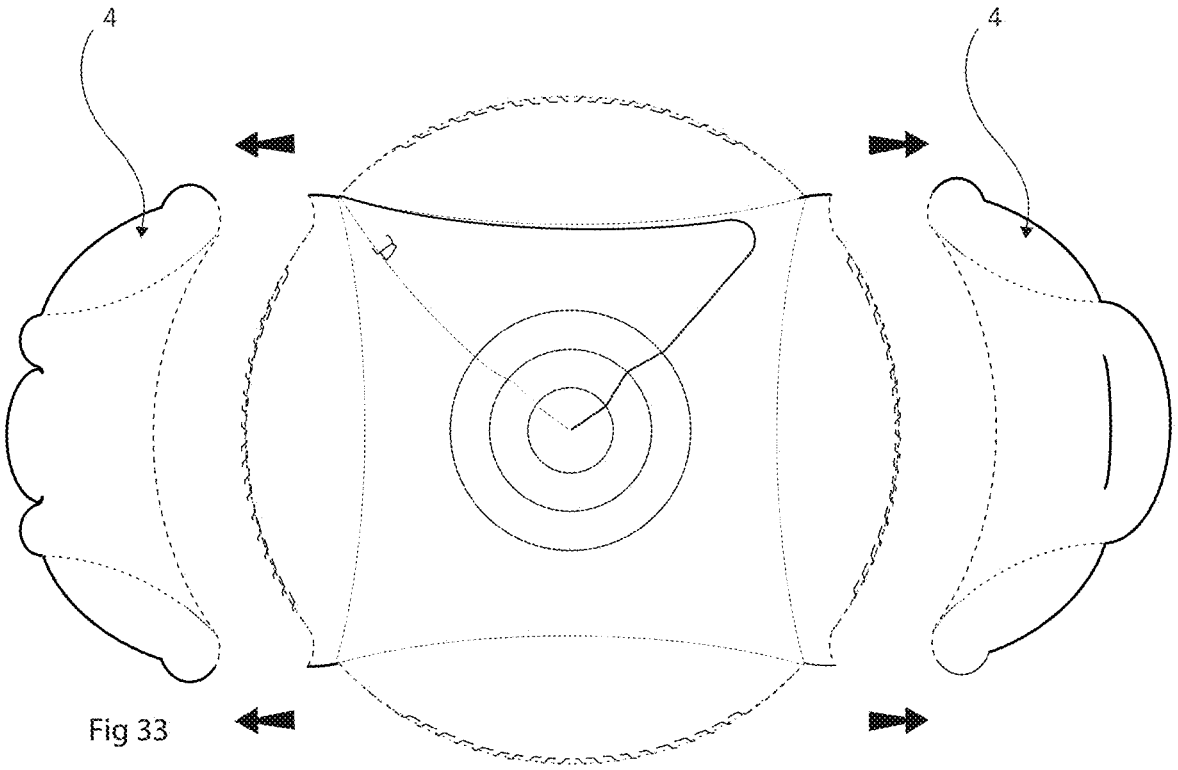
FIG. 33 is a top view of a closed assembled/folded stylized container, showing detachable flaps.
Figure 34:
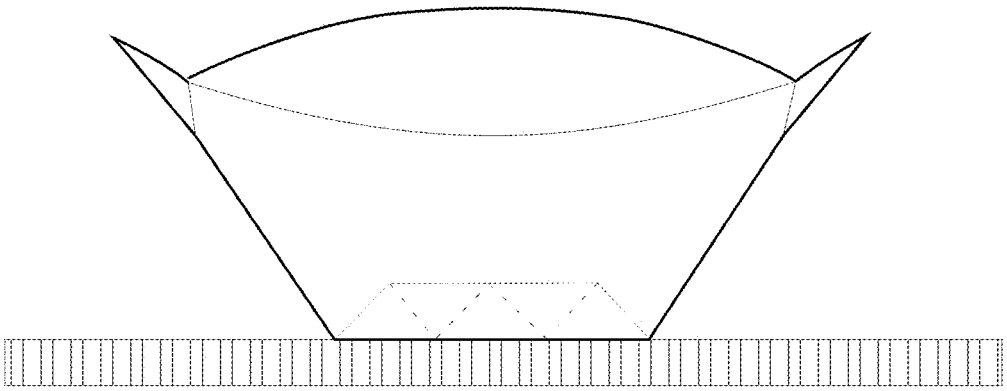
FIG. 34 is a side view of a closed stylized container.
Figure 35:
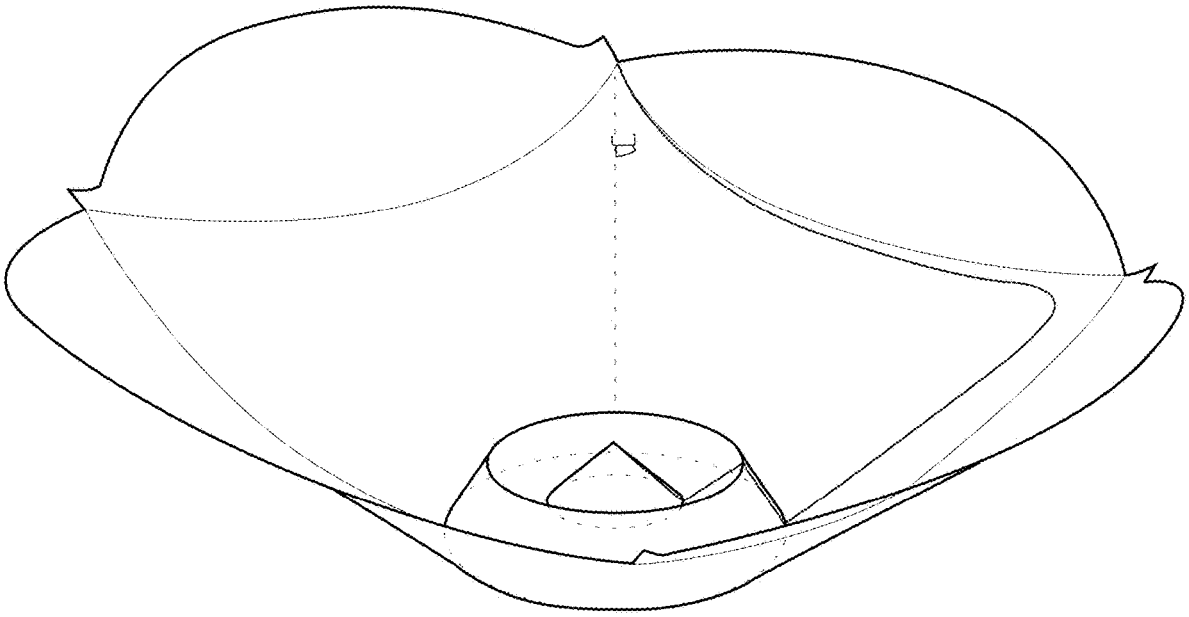
FIG. 35 is a perspective view of an open stylized container.

FIG. 24 shows a locking mechanism for the container. A first primary closing fin 4.1*a* has a locking tab 5.3*a* that fits into a locking slit 5.4*a* of a second primary closing fin 4.1*b*. A first secondary closing fin 4.2*a* has a locking tab 5.3*b* that fits into a locking slit 5.4*b* of a second secondary closing fin 4.2*b*. The locking tabs (5.3*a* and 5.3*b*) and the locking slits (5.4*a* and 5.4*b*) close the container. The dashed lines in the closing fins (4.1*a*, 4.1*b*, and 4.2*a*, 4.2*b*) are configured to allow to remove each closing fin as shown in FIGS. 31 and 33.

EXAMPLES

A foldable laminate container comprises a container body having an engraved geometric outline. The foldable laminate container further comprises a three engraved concentric circles, an internal circle, a middle circle, and an external circle. The concentric circles are configured to form a concentric cone circular base, a center of the concentric circular base is an upper vertex of an engraved overlap triangle. The foldable container is configured to fold into a three-dimensional container when the overlap triangle is folded and the concentric cone circular base forms an cone from the center to the internal circle, a base crest between the external circle and the internal circle, which are concentric to the cone.

The internal circle has an internal radius, the middle circle has a middle radius, and the external circle has an external radius and wherein the external radius is three times the internal radius, and the middle radius is twice the internal radius. The foldable laminate container has a plurality of lines tangent to the internal circle are proportionately distributed in an area between the internal circle and the middle circle, and wherein two of the plurality of lines form a "V" aligned to an overlap triangle axis. In some embodiments, the container has nine lines tangent to the internal circle.

In various embodiments, the laminate container has a geometric outline in the shape of a pentagon or a hexagon. It is understood that other shapes may be used. The foldable laminate container, in some embodiments, has an engraved overlap triangle extends from the center of the inner circle to a first and a second corner of the geometric outline. The container further includes an engraved first triangle line that extends from the center of the inner circle to and is orthogonal to a base of the geometric outline. A second triangle line extends from an edge of the geometric outline parallel to a triangle axis to an edge of the triangle outline. The foldable laminate container has a lid system that comprises a first primary closing fin, a second primary closing fin, a first secondary closing fin, and a second secondary closing fin, all of which extend away from respective edges of the geometric outline. In one embodiment, the lid system has a handling fin.

The foldable laminate container, in some embodiments, has a first primary closing fin and the second primary closing fin comprise a primary flap and a secondary flap and a first closing guide and a secondary closing guide.

The container lid system, in some embodiments, consists of four fins, two primary fins and two secondary fins arranged in an interspersed manner around the container pentagonal outline; the two trapezoidal primary fins have notches in their cusp counterclockwise, which form the container flaps surrounded by an arch formed by the container handles; the two secondary fins do not exceed a primary fins' size.

The lid system in some embodiments, has four equilateral triangle-like high volume fins arranged around the container pentagonal outline; closing structural rims containing the notches; extend from the triangles' external sides. The square outline container comprises a cone cavity is intersected by another smaller cone aligned on the same axis; said smaller cone retreats on itself forming the double concentric cone circular base; and a container square outline extends in four fins that form the container lid system and the container body closes with the bend of the overlap triangle's two halves which must be superimposed on one of their sides.

In one embodiment, the container has a square outline, a cone body and circular base of double concentric cone and a flat roof formed by the container lid system fin. In other embodiments, the container has a square outline, a cone body and circular base of double concentric cone, with a pyramidal roof formed by the container lid system fin.

In some embodiments, the lid system has a first primary closing fin, a second primary closing fin, a first secondary closing fin, and a second secondary closing fin, are configure to be detachably removed from the foldable laminate container once closed. The lid system, in some embodiments, has a locking tab and a locking slit.

In other embodiments, the foldable laminate container has an engraved geometric outline with edges rounded towards the center of the concentric circular base and engraved lines rounded away from the center of the concentric circular base. The edges rounded towards the center of the concentric circular base and the engrave lines rounded away from the center of the concentric circular base form a vertical or semi-vertical wall of the container. The vertical or semi-vertical wall allow for a top of the container to be flat and allow the container to be stacked on a second container. In some embodiments multiple containers can be stacked on top of each other.

The invention has been described with references to a preferred embodiment. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A foldable laminate container, comprising:

a container body having an engraved geometric outline;

the foldable laminate container further comprises a three engraved concentric circles, an internal circle, a middle circle, and an external circle, wherein the concentric circles are configured to form a concentric cone circular base, a center of the concentric circular base is an upper vertex of an engraved overlap triangle; and wherein, the foldable container is configured to fold into a three-dimensional container when the overlap triangle is folded and the concentric cone circular base forms an cone from the center to the internal circle, a base crest between the external circle and the internal circle, which are concentric to the cone.

2. The foldable laminate container, according to claim 1, wherein the internal circle has an internal radius, the middle circle has a middle radius, and the external circle has an external radius and wherein the external radius is three times the internal radius, and the middle radius is twice the internal radius.

3. The foldable laminate container, according to claim 1, further comprising a plurality of lines tangent to the internal circle are proportionately distributed in an area between the internal circle and the middle circle, and wherein two of the plurality of lines form a "V" aligned to an overlap triangle axis.

4. The foldable laminate container, according to claim 3, comprising nine lines tangent to the internal circle.

5. The foldable laminate container, according to claim 1, wherein the geometric outline is one of a pentagon or a hexagon.

6. The foldable laminate container, according to claim 1, wherein the engraved overlap triangle extends from the center of the inner circle to a first and a second corner of the geometric outline; the container further includes an engraved first triangle line that extends from the center of the inner circle to and is orthogonal to a base of the geometric outline; a second triangle line extends from an edge of the geometric outline parallel to a triangle axis to an edge of the triangle outline.

7. The foldable laminate container, according to claim 1, further comprising a first primary closing fin, a second primary closing fin, a first secondary closing fin, and a second secondary closing fin, all of which extend away from respective edges of the geometric outline.

8. The foldable laminate container, according to claim 7, further comprising a handling fin.

9. The foldable laminate container, according to claim 7, wherein the first primary closing fin and the second primary closing fin comprise a primary flap and a secondary flap and a first closing guide and a secondary closing guide.

10. The foldable laminate container, according to claim 9, further comprising a container lid system, which consists of four fins, two primary fins and two secondary fins arranged in an interspersed manner around the container pentagonal outline; the two trapezoidal primary fins have notches in their cusp counterclockwise, which form the container flaps surrounded by an arch formed by the container handles; the two secondary fins do not exceed a primary fins' size.

11. The foldable laminate container, according to claim 7, wherein the first primary closing fin, a second primary closing fin, a first secondary closing fin, and a second secondary closing fin, are configure to be detachably removed from the foldable laminate container once closed.

12. The foldable laminate container, according to claim 7, further comprising a locking tab and a locking slit.

13. The foldable laminate container, according to claim 1, wherein the container lid system, which consists of four equilateral triangle-like high volume fins arranged around the container pentagonal outline; closing structural rims containing the notches; extend from the triangles' external sides.

14. The foldable laminate container, according to claim 1, wherein a square outline container comprises a cone cavity is intersected by another smaller cone aligned on the same axis; said smaller cone retreats on itself forming the double concentric cone circular base; and a container square outline extends in four fins that form the container lid system and the container body closes with the bend of the overlap triangle's two halves which must be superimposed on one of their sides.

15. The foldable laminate container, according to claim 1, further comprising a square outline container, cone body and circular base of double concentric cone, with a flat roof formed by the container lid system fin superposition and fitting.

16. The foldable laminate container, according to claim 1, further comprising a square outline container, cone body and circular base of double concentric cone, with a pyramidal roof formed by the container lid system fin superposition and fitting.

17. The foldable laminate container, according to claim 1, wherein the engraved geometric outline has edges rounded towards the center of the concentric circular base and engraved lines rounded away from the center of the concentric circular base.

18. The foldable laminate container, according to claim 17, wherein the edges rounded towards the center of the concentric circular base and the engrave lines rounded away from the center of the concentric circular base form a vertical or semi-vertical wall of the container.

19. The foldable laminate container, according to claim 18, wherein the vertical or semi-vertical wall allow for a top of the container to be flat and allow the container to be stacked on a second container.

* * * * *